US011731254B2

(12) United States Patent
Kabbes et al.

(10) Patent No.: US 11,731,254 B2
(45) Date of Patent: Aug. 22, 2023

(54) FASTENER DRIVING TOOL WITH DRIVER POSITION SENSORS

(71) Applicant: Kyocera Senco Industrial Tools, Inc., Cincinnati, OH (US)

(72) Inventors: Anthony D. Kabbes, Cincinnati, OH (US); Thomas Matthew Webster, Cleves, OH (US); Steven R. Streicher, Cincinnati, OH (US); Thomas A. McCardle, Cincinnati, OH (US); William H. Hoffman, Cincinnati, OH (US); Christopher D. Klein, Cincinnati, OH (US)

(73) Assignee: Kyocera Senco Industrial Tools, Inc., Cincinnati, OH (US)

( * ) Notice: Subject to any disclaimer, the term of this patent is extended or adjusted under 35 U.S.C. 154(b) by 293 days.

(21) Appl. No.: 17/060,717

(22) Filed: Oct. 1, 2020

(65) Prior Publication Data

US 2021/0016424 A1 Jan. 21, 2021

Related U.S. Application Data

(63) Continuation of application No. 15/849,023, filed on Dec. 20, 2017, now Pat. No. 10,821,585.

(Continued)

(51) Int. Cl.

| | |
|---|---|
| ***B25C 1/06*** | (2006.01) |
| ***B25C 1/00*** | (2006.01) |
| ***B25C 1/04*** | (2006.01) |

(52) U.S. Cl.

CPC ..... *B25C 1/008* (2013.01); *B25C 1/047* (2013.01); *B25C 1/06* (2013.01)

(58) Field of Classification Search

USPC ..... 227/1

See application file for complete search history.

(56) References Cited

U.S. PATENT DOCUMENTS

| | | | |
|---|---|---|---|
| 860,536 | A | 7/1907 | Ellingham |
| 1,774,967 | A | 9/1930 | Ellis |

(Continued)

FOREIGN PATENT DOCUMENTS

| | | |
|---|---|---|
| DE | 1503164 | 3/1970 |
| DE | 8711784 | 8/1987 |

(Continued)

OTHER PUBLICATIONS

Two-page "Tool Assembly" drawing of Senco Model No. SN952XP pneumatic tool; dated Mar. 4, 2008; representative of earlier tools in public use before 2006; Admitted Prior Art.

(Continued)

*Primary Examiner* — Chinyere J Rushing-Tucker
(74) *Attorney, Agent, or Firm* — Frederick H. Gribbell; Russell F. Gribbell

(57) ABSTRACT

A gas spring fastener driving tool, having a cylinder filled with compressed gas that forces a piston/driver through a driving stroke movement; a rotary-to-linear lifter, then moves the piston/driver back to its ready position, preparing the tool for another driving stroke. The driver has protrusions (teeth) along its edges to contact extending pins of the lifter member, for lifting the driver during a return stroke. The driver's movements are detected by position sensors, and the information provided by those position sensors is used to prevent the lifter from impacting against the driver in situations where the driver did not finish its driving stroke in a correct ("in specification") position. The use of two position sensors allows a Dry Fire diagnostic test to determine if gas pressure in the gas storage chamber is too high, or has become too low.

15 Claims, 17 Drawing Sheets

Related U.S. Application Data

(60) Provisional application No. 62/438,252, filed on Dec. 22, 2016.

(56) References Cited

U.S. PATENT DOCUMENTS

| | | | |
|---|---|---|---|
| 2,575,455 | A | 11/1951 | Lang |
| 2,814,041 | A | 11/1957 | Haley |
| 2,933,290 | A | 4/1960 | Ryder |
| 3,589,588 | A | 6/1971 | Vasku |
| 3,847,322 | A | 11/1974 | Smith |
| 3,878,902 | A | 4/1975 | Matsuo |
| 3,913,685 | A | 10/1975 | Enstrom |
| 3,924,692 | A | 12/1975 | Saari |
| 4,203,353 | A | 5/1980 | Bernham et al. |
| 4,215,808 | A | 8/1980 | Sollberger et al. |
| 4,530,455 | A | 7/1985 | Vomberger |
| 4,741,518 | A | 5/1988 | Wallis |
| 5,199,627 | A | 4/1993 | Christensen |
| 5,503,319 | A | 4/1996 | Lai |
| 5,605,268 | A | 2/1997 | Hayashi |
| 5,720,423 | A | 2/1998 | Kondo et al. |
| 6,533,156 | B1 | 3/2003 | Chang |
| 6,705,503 | B1 | 3/2004 | Pedicini |
| 6,938,811 | B2 | 9/2005 | Ehmig et al. |
| 6,971,567 | B1 | 12/2005 | Cannaliato |
| 6,997,367 | B2 | 2/2006 | Hu |
| 7,040,521 | B2 | 5/2006 | Kolodziej et al. |
| 7,225,961 | B1 | 6/2007 | Lee |
| 7,225,962 | B2 | 6/2007 | Porth et al. |
| 7,494,036 | B2 | 2/2009 | Shima |
| 8,011,547 | B2 | 9/2011 | Leimbach et al. |
| 8,267,297 | B2 | 9/2012 | Leimbach et al. |
| 2003/0218042 | A1 | 11/2003 | Odoni et al. |
| 2005/0217875 | A1 | 10/2005 | Forster |
| 2006/0180631 | A1 | 8/2006 | Pedicini |
| 2007/0007319 | A1 | 1/2007 | Simonelli |
| 2007/0045377 | A1 | 3/2007 | Towfighi |
| 2008/0041914 | A1 | 2/2008 | Simonelli |
| 2008/0067213 | A1 | 3/2008 | Shima |
| 2008/0190988 | A1 | 8/2008 | Pedicini |
| 2009/0090762 | A1* | 4/2009 | Leimbach ..... B25C 5/13 227/136 |
| 2014/0263535 | A1 | 9/2014 | Rajani |
| 2015/0158160 | A1* | 6/2015 | Kato ..... B25C 1/06 91/55 |
| 2018/0036870 | A1 | 2/2018 | Komazaki |
| 2018/0126528 | A1* | 5/2018 | Pomeroy ..... B25C 1/008 |
| 2018/0154505 | A1 | 6/2018 | Sato |

FOREIGN PATENT DOCUMENTS

| | | |
|---|---|---|
| GB | 1559571 | 1/1980 |
| JP | 201668221 | 5/2016 |

OTHER PUBLICATIONS

One-page magnified view of "Tool Assembly" drawing of Senco Model No. SN952XP pneumatic tool; Mar. 4, 2008; representative of earlier tools in public use before 2006; Admitted Prior Art.

International Search Report, PCT/US17/67600, 18 pages (dated Feb. 22, 2018).

* cited by examiner

FASTENER DRIVING TOOL WITH DRIVER POSITION SENSORS

CROSS-REFERENCE TO RELATED APPLICATIONS

The present application is a continuation to application Ser. No. 15/849,023, titled "FASTENER DRIVING TOOL WITH DRIVER POSITION SENSORS," filed on Dec. 20, 2017, which claims priority to provisional patent application Ser. No. 62/438,252, titled "FASTENER DRIVING TOOL WITH DRIVER POSITION SENSORS," filed on Dec. 22, 2016.

TECHNICAL FIELD

The technology disclosed herein relates to linear fastener driving tools and, more particularly, directed to portable tools that drive staples, nails, or other linearly driven fasteners. The technology is specifically disclosed as a gas spring fastener driving tool, in which a cylinder filled with compressed gas is used to quickly force a piston through a driving stroke movement, while also driving a fastener into a workpiece. The piston is then moved back to its starting position by use of a rotary-to-linear lifter, which again compresses the gas above the piston, thereby preparing the tool for another driving stroke. A driver member (or simply, "driver") is attached to the piston, and has protrusions along its edges that are used to contact the lifter member (or simply, "lifter"), which lifts the driver during a return stroke. A pivotable latch is controlled to move into either an interfering position or a non-interfering position with respect to the driver protrusions, and acts as a safety device, by preventing the driver from making a full driving stroke at an improper time. The latch also aids the lift for a lifter that rotates more than once, in a single return stroke.

The driver's movements are detected by position sensors, and the information provided by those position sensors is used to prevent the lifter from impacting against the driver in situations where the driver did not finish its driving stroke in a correct position. If the driver's protrusions are out of position, then the lifter will not be able to contact the driver in a correct manner, and instead of lifting the driver back to its "ready position," the lifter's pins might contact the driver so as to jam against the driver, and potentially even break the driver at the point of contact.

A first failure mode can occur if the piston stop has sufficiently worn to the point where the driver ends its driving stroke too low in the driver track. In other words, the "driven position" of the driver against the piston stop is out of specification, and is not at its anticipated "normal" ending position. This type of ending mis-position of the driver is referred to as a "Mode B" Failure, herein. One can expect this Mode B failure to occur in virtually every such tool eventually (if the tool is used as a "production device"), but these failures typically do not occur until the tool has undergone tens of thousands of operating cycles.

A second failure mode can occur if the driver is prevented from completing its driving stroke because of a fastener that is jammed in the fastener track of the guide body; this mechanical interference can prevent the driver from moving all the way to the bottom of its normal driving stroke. Again, if this occurs, the driven position of the driver is out of specification, and not at its anticipated "normal" ending position. This type of ending mis-position of the driver is referred to as a "Mode A" Failure, herein.

In an exemplary embodiment, the driver exhibits a through-hole at a mid-portion of its elongated face, and one of the position sensors is located in the guide body at a location where it can detect that through-hole at the end of a driving stroke. If that position sensor (referred to herein as the "DOWN sensor") does not detect the expected through-hole at the correct time, then the tool's system controller determines that one of the tool's failure modes has occurred. For a Mode A Failure, the through-hole never arrives at its expected "bottom" or "end" position, and therefore, the DOWN sensor never detects the through-hole at any time during the fastener driving stroke.

For a Mode B Failure, the through-hole will actually arrive at its expected "bottom" or "end" position, but the driver keeps moving to a yet lower position in the drive track, and when it finally stops moving, the through-hole is no longer at the correct (anticipated) position. Therefore, the DOWN sensor only detects the through-hole for a moment, and then it ceases detecting the through-hole later in that (lengthened) driving stroke, as the driver continues moving to its final driven position, which is too low (out of spec) in the driver track.

In the embodiment(s) illustrated herein, the position sensors are optical sensors, in which a light-emitting device (such as a light-emitting diode, or "LED") is placed on one side of the drive track in the guide body, while a light-detecting device (such as a phototransistor or a photodiode—a photodetector, or "PD") is placed on the opposite side of that drive track. If the through-hole of the driver is placed at the "normal" ending position (i.e., at its anticipated end position of a driving stroke), then the light emitted by the LED will be received by the PD. If, however, the main body portion of the "elongated driver member" is positioned between the LED and the PD—which will occur at virtually all other positions of the driver—then the light emitted by the LED will not reach the PD.

It should be noted that the recommended position sensors are "non-contact" devices, and thus should operate inside the overall tool without any mechanical wear. Other types of proximity detecting sensors could be used, if desired, without departing from the principles of this technology. A sensor that makes actual physical contact could be used, but is not recommended for this engineering application.

In a preferred embodiment, there are two position sensors: the DOWN sensor that was described above, and an UP sensor that is placed at a different position in the drive track of the guide body. In the illustrated embodiment(s), the UP sensor is an optical sensor, in which a second LED is placed on one side of the drive track in the guide body, while a second PD is placed on the opposite side of that drive track. But for the UP sensor, the positions of these two components (the LED and PD) are located just below the bottom edge of the "elongated driver member" when that driver is held at its ready position, after a return stroke has occurred. Therefore, the driver's elongated body will not block the light being emitted by the LED of the UP sensor, and therefore, the PD will receive that light during the time that the driver is held at the ready position. Very quickly after a driving stroke begins, however, the leading edge (the "bottom" edge) of the driver will pass between the UP sensor's LED and PD components, and then the light emitted by the LED will not be received by the PD, probably for the remainder of the driving stroke, all the way to its "driven" position.

In an alternative embodiment, there is only a single position sensor placed in the driver track of the guide body, which is the DOWN sensor. Most of the functionality of the electronically-controlled fastener driving tool can be accomplished using only the DOWN sensor. However, both the UP and DOWN sensors are needed for a diagnostic testing mode, known as the "Dry Fire" Mode. This Dry Fire diagnostic test can be performed to determine if the gas pressure in the gas storage chamber is becoming too low for the gas-spring piston to successfully drive fasteners in the future. (If the gas pressure becomes too low, the tool is supposed to be serviced, so that additional pressurized gas can be placed into the gas storage chamber, thereby raising its pressure.) The procedure for this Dry Fire test is to cycle the tool without a fastener in the fastener track, and to track the time interval for the driver to pass by the UP sensor, and then pass by the DOWN sensor. If the time interval for this movement of the driver is too great, then it can be presumed that the gas pressure is too low to sufficiently push the piston/driver combination with sufficient force.

STATEMENT REGARDING FEDERALLY SPONSORED RESEARCH OR DEVELOPMENT

None.

BACKGROUND

An early air spring fastener driving tool is disclosed in U.S. Pat. No. 4,215,808, to Sollberger. The Sollberger patent used a rack and pinion-type gear to "jack" the piston back to its driving position. A separate motor was to be attached to a belt that was worn by the user; a separate flexible mechanical cable was used to take the motor's mechanical output to the driving tool pinion gear, through a drive train.

Another air spring fastener driving tool is disclosed in U.S. Pat. No. 5,720,423, to Kondo. This Kondo patent used a separate air replenishing supply tank with an air replenishing piston to refresh the pressurized air needed to drive a piston that in turn drove a fastener into an object.

Another air spring fastener driving tool is disclosed in published patent application no. US2006/0180631, by Pedicini, which uses a rack and pinion to move the piston back to its driving position. The rack and the pinion gear are decoupled during the drive stroke, and a sensor is used to detect this decoupling. The Pedicini tool uses a release valve to replenish the air that is lost between nail drives.

Senco Brands, Inc. sells a product line of automatic power tools referred to as nailers, including tools that combine the power and the utility of a pneumatic tool with the convenience of a cordless tool. One primary feature of such tools is that they use pressurized air to drive a piston that shoots the nail. In some Senco tools, that pressurized air is re-used, over and over, so there is no need for any compressed air hose, or for a combustion chamber that would require fuel.

Although Senco "air tools" are quite reliable and typically can endure thousands of shooting cycles without any significant maintenance, they do have wear characteristics for certain components. For example, the piston stop can degrade over time, and when that occurs, the piston and driver member can end up at a lower position than is desired, at the end of a drive stroke. If the out of position situation reaches more than a minimum specified distance, then the lifter that brings the driver back to its ready position may not properly engage the "teeth" of the driver member, and instead may jam against the driver member, or perhaps even break the driver due to forceful mechanical contact, without being able to move the driver up toward its ready position, as is desired.

Another undesirable situation is when a fastener becomes jammed or otherwise stalled within the driver track of the tool. If that occurs, the user may not realize it, especially if the user is performing multiple quick driving cycles, which is normal for many production and construction situations. So if a fastener has not been properly exited from the driver track, then the next driving cycle will potentially cause a problem when the driver comes down the driver track and contacts the stalled or jammed previous fastener. This condition can jam the driver, and potentially cause a situation where the lifter pins will make undesirable contact with the driver, not only further jamming the mechanical components of the tool, but potentially contacting the driver with enough force that it could break the driver.

SUMMARY

Accordingly, it is an advantage of the present technology disclosed herein to provide a fastener driving tool that includes at least one position sensor for determining whether or not the driver member ends its driving stroke at a correct position that is within specification.

It is another advantage of the present technology to provide a fastener driving tool having at least one position sensor to determine the ending position of the driver member after a driving stroke, and having a dynamic braking circuit to prevent the lifter subassembly from impacting the driver member with a force that might jam or break the driver member.

It is a further advantage of the present technology to provide a fastener driving tool with at least two position sensors that detect movements of the driver member, in which a diagnostic test can be performed by measuring the time interval between passing of the driver member as detected by the two position sensors, and in which this "dry fire test" can be easily performed by a user without taking the tool to a service center.

Additional advantages and other novel features will be set forth in part in the description that follows and in part will become apparent to those skilled in the art upon examination of the following or may be learned with the practice of the technology disclosed herein.

To achieve the foregoing and other advantages, and in accordance with one aspect, a driver machine adapted for use in a fastener driving tool is provided, which comprises: (a) a hollow cylinder having a movable piston therewithin; (b) a guide body that is sized and shaped to receive a fastener that is to be driven; (c) an elongated driver that is in mechanical communication with the piston, the driver being sized and shaped to push the fastener from an exit portion of the guide body, the driver extending from a first end to a second end and having an elongated face, the first end being in mechanical communication with the piston, the second end making contact with the fastener during a driving stroke, the driver having an opening at a predetermined location in the elongated face that extends completely through the driver; (d) a lifter that, under first predetermined conditions, moves the driver from a driven position toward a ready position during a return stroke; (e) an electrical energy source; (f) a first position sensor which detects the opening if the driver is correctly located at the driven position after the driving stroke; and (g) a system controller comprising: (i) a processing circuit, (ii) a memory circuit, (iii) an input/output interface (I/O) circuit, the I/O circuit being in communication with the first position sensor so that a first signal produced by the first position sensor is received as a first input signal at the processing circuit; wherein: the system controller executes computer software code to perform functions of: (i) under second predetermined conditions, to allow the driver to undergo a driving stroke, thereby moving the driver from the ready position toward the driven position; (ii) to determine a start time $T_X$ at a beginning of the driving stroke; (iii) after the time $T_X$ occurs, to wait for a time interval $T_B$, then to determine if the first input signal is at a first logic state or a second logic state, such that: (A) if the first position sensor does not detect the opening of the driver, then the first input signal will be at the first logic state, and (B) if the first position sensor does detect the opening of the driver, then the first input signal will be at the second logic state; (iv) if the first input signal is at the first logic state after the time interval TB, then the driver machine is operating abnormally; and (v) if the first input signal is at the second logic state after the time interval TB, then the driver machine is operating normally.

In accordance with another aspect, a driver machine adapted for use in a fastener driving tool is provided, which comprises: (a) a hollow cylinder having a movable piston therewithin; (b) a guide body that is sized and shaped to receive a fastener that is to be driven; (c) an elongated driver that is in mechanical communication with the piston, the driver being sized and shaped to push the fastener from an exit portion of the guide body, the driver extending from a first end to a second end and having an elongated face, the first end being in mechanical communication with the piston, the second end making contact with the fastener during a driving stroke, the driver having an opening at a predetermined location in the elongated face that extends completely through the driver; (d) a lifter that, under first predetermined conditions, moves the driver from a driven position toward a ready position during a return stroke; (e) an electrical energy source; (f) a first position sensor which detects the opening if the driver is correctly located at the driven position after the driving stroke; and (g) a system controller comprising: (i) a processing circuit, (ii) a memory circuit, (iii) an input/output interface (I/O) circuit, the I/O circuit being in communication with the first position sensor so that a first signal produced by the first position sensor is received as a first input signal at the processing circuit; wherein: the system controller executes computer software code to perform functions of: (i) under second predetermined conditions, to allow the driver to undergo a driving stroke, thereby moving the driver from the ready position toward the driven position; (ii) to determine a start time $T_X$ at a beginning of the driving stroke; (iii) after the time $T_X$ occurs, to wait for a time interval $T_A$, then to determine if the first input signal changed state at least once after the time $T_X$, such that; (iv) if the first input signal did not change state between the time $T_X$ and the time interval $T_A$, then the driver machine is operating abnormally; and (v) if the first input signal did change state between the time $T_X$ and the time interval $T_A$, then the driver machine may be operating normally, depending upon other conditions.

In accordance with yet another aspect, a driver machine adapted for use in a fastener driving tool is provided, which comprises: (a) a hollow cylinder having a movable piston therewithin; (b) a guide body that is sized and shaped to receive a fastener that is to be driven; (c) an elongated driver that is in mechanical communication with the piston, the driver being sized and shaped to push the fastener from an exit portion of the guide body, the driver extending from a first end to a second end and having an elongated face, the first end being in mechanical communication with the piston, the second end making contact with the fastener during a driving stroke, the driver having an opening at a predetermined location in the elongated face that extends completely through the driver; (d) a lifter that, under first predetermined conditions, moves the driver from a driven position toward a ready position during a return stroke; (e) an electrical energy source; (f) a first position sensor which detects the opening if the driver is correctly located at the driven position after the driving stroke; (g) a second position sensor which detects motion of the driver if the driver begins moving through a driving stroke, from the ready position toward the driven position; and (h) a system controller comprising: (i) a processing circuit, (ii) a memory circuit, (iii) an input/output interface (I/O) circuit, the I/O circuit being in communication with the first position sensor so that a first signal produced by the first position sensor is received as a first input signal at the processing circuit, and the I/O circuit being in communication with the second position sensor so that a second signal produced by the second position sensor is received as a second input signal at the processing circuit; wherein: the system controller executes computer software code to perform functions of: (i) under second predetermined conditions, to allow the driver to undergo a driving stroke, thereby moving the driver from the ready position toward the driven position; (ii) to determine a time $T_X$ when the second input signal first changes state, after the driver begins the driving stroke; (iii) after the time $T_X$ occurs, to wait for a time interval $T_B$, then to determine if the first input signal is at a first logic state or a second logic state, such that: (A) if the first position sensor does not detect the opening of the driver, then the first input signal will be at the first logic state, and (B) if the first position sensor does detect the opening of the driver, then the first input signal will be at the second logic state; (iv) if the first input signal is at the first logic state after the time interval $T_B$, then the driver machine is operating abnormally; and (v) if the first input signal is at the second logic state after the time interval $T_B$, then the driver machine is operating normally.

In accordance with still another aspect, a driver machine adapted for use in a fastener driving tool is provided, which comprises: (a) a hollow cylinder having a movable piston therewithin; (b) a guide body that is sized and shaped to receive a fastener that is to be driven; (c) an elongated driver that is in mechanical communication with the piston, the driver being sized and shaped to push the fastener from an exit portion of the guide body, the driver extending from a first end to a second end and having an elongated face, the first end being in mechanical communication with the piston, the second end making contact with the fastener during a driving stroke, the driver having an opening at a predetermined location in the elongated face that extends completely through the driver; (d) a lifter that, under first predetermined conditions, moves the driver from a driven position toward a ready position during a return stroke; (e) an electrical energy source; (f) a first position sensor which detects the opening if the driver is correctly located at the driven position after the driving stroke; (g) a second position sensor which detects motion of the driver if the driver begins moving through a driving stroke, from the ready position toward the driven position; and (h) a system controller comprising: (i) a processing circuit, (ii) a memory circuit, (iii) an input/output interface (I/O) circuit, the I/O circuit being in communication with the first position sensor so that a first signal produced by the first position sensor is received as a first input signal at the processing circuit, and the I/O circuit being in communication with the second position sensor so that a second signal produced by the second position sensor is received as a second input signal at the processing circuit; wherein: the system controller executes computer software code to perform functions of: (i) under second predetermined conditions, to allow the driver to undergo a driving stroke, thereby moving the driver from the ready position toward the driven position; (ii) to determine a time $T_X$ when the second input signal first changes state, after the driver begins the driving stroke; (iii) after the time $T_X$ occurs, to wait for a time interval $T_A$, then to determine if the first input signal changed state at least once after the time $T_X$, such that; (iv) if the first input signal did not change state between the time $T_X$ and the time interval $T_A$, then the driver machine is operating abnormally; and (v) if the first input signal did change state between the time $T_X$ and the time interval $T_A$, then the driver machine may be operating normally, depending upon other conditions.

In accordance with a further aspect, a driver machine adapted for use in a fastener driving tool is provided, which comprises: (a) a hollow cylinder having a movable piston therewithin; (b) a guide body that is sized and shaped to receive a fastener that is to be driven; (c) an elongated driver that is in mechanical communication with the piston, the driver being sized and shaped to push the fastener from an exit portion of the guide body, the driver extending from a first end to a second end and having an elongated face, the first end being in mechanical communication with the piston, the second end making contact with the fastener during a driving stroke, the driver having an opening at a predetermined location in the elongated face that extends completely through the driver; (d) an electrical energy source; (e) a first position sensor which detects the opening if the driver is correctly located at the driven position after the driving stroke; (f) a second position sensor which detects motion of the driver if the driver begins moving through a driving stroke, from the ready position toward the driven position; and (g) a system controller comprising: (i) a processing circuit, (ii) a memory circuit, (iii) an input/output interface (I/O) circuit, the I/O circuit being in communication with the first position sensor so that a first signal produced by the first position sensor is received as a first input signal at the processing circuit, and the I/O circuit being in communication with the second position sensor so that a second signal produced by the second position sensor is received as a second input signal at the processing circuit; wherein: the system controller executes computer software code to perform functions of: (i) under second predetermined conditions, to allow the driver to undergo a driving stroke, thereby moving the driver from the ready position toward the driven position, with no fastener to be driven during a "dry fire test" mode; (ii) to determine a time $T_X$ when the second input signal first changes state, after the driver begins the driving stroke, during the "dry fire test" mode; (iii) to determine a time $T_{DF}$ when the first input signal first changes state, after the driver nears the driven position, during the "dry fire test" mode; (iv) to calculate a time difference $T_E$, which equals $T_{DF}$ minus $T_X$, during the "dry fire test" mode; (v) to compare the time difference $T_E$ to a predetermined expected time $T_F$, during the "dry fire test" mode, and if the $T_E$ is greater than the $T_F$, then to provide an indication of a failed dry fire test for the fastener driving tool.

In accordance with a yet further aspect, a driver machine adapted for use in a fastener driving tool is provided, which comprises: (a) a hollow cylinder having a movable piston therewithin; (b) a guide body that is sized and shaped to receive a fastener that is to be driven; (c) an elongated driver that is in mechanical communication with the piston, the driver being sized and shaped to push the fastener from an exit portion of the guide body, the driver extending from a first end to a second end and having an elongated face, the first end being in mechanical communication with the piston, the second end making contact with the fastener during a driving stroke, the driver exhibiting a detection zone at a predetermined location of the driver; (d) a lifter that, under first predetermined conditions, moves the driver from a driven position toward a ready position during a return stroke; (e) an electrical energy source; (f) a first non-contact position sensor which detects the detection zone if the driver is correctly located at the driven position after the driving stroke; and (g) a system controller comprising: (i) a processing circuit, (ii) a memory circuit, (iii) an input/output interface (I/O) circuit, the I/O circuit being in communication with the first non-contact position sensor so that a first signal produced by the first non-contact position sensor is received as a first input signal at the processing circuit; wherein: the system controller executes computer software code to perform functions of: (i) under second predetermined conditions, to allow the driver to undergo a driving stroke, thereby moving the driver from the ready position toward the driven position; (ii) to determine a start time $T_X$ at a beginning of the driving stroke; (iii) after the time $T_X$ occurs, to wait for a time interval $T_B$, then to determine if the first input signal is at a first logic state or a second logic state, such that: (A) if the first non-contact position sensor does not detect the detection zone of the driver, then the first input signal will be at the first logic state, and (B) if the first non-contact position sensor does detect the detection zone of the driver, then the first input signal will be at the second logic state; (iv) if the first input signal is at the first logic state after the time interval $T_B$, then the driver machine is operating abnormally; and (v) if the first input signal is at the second logic state after the time interval $T_B$, then the driver machine is operating normally.

Still other advantages will become apparent to those skilled in this art from the following description and drawings wherein there is described and shown a preferred embodiment in one of the best modes contemplated for carrying out the technology. As will be realized, the technology disclosed herein is capable of other different embodiments, and its several details are capable of modification in various, obvious aspects all without departing from its principles. Accordingly, the drawings and descriptions will be regarded as illustrative in nature and not as restrictive.

BRIEF DESCRIPTION OF THE DRAWINGS

The accompanying drawings incorporated in and forming a part of the specification illustrate several aspects of the technology disclosed herein, and together with the description and claims serve to explain the principles of the technology. In the drawings:

DETAILED DESCRIPTION

Figure 1:
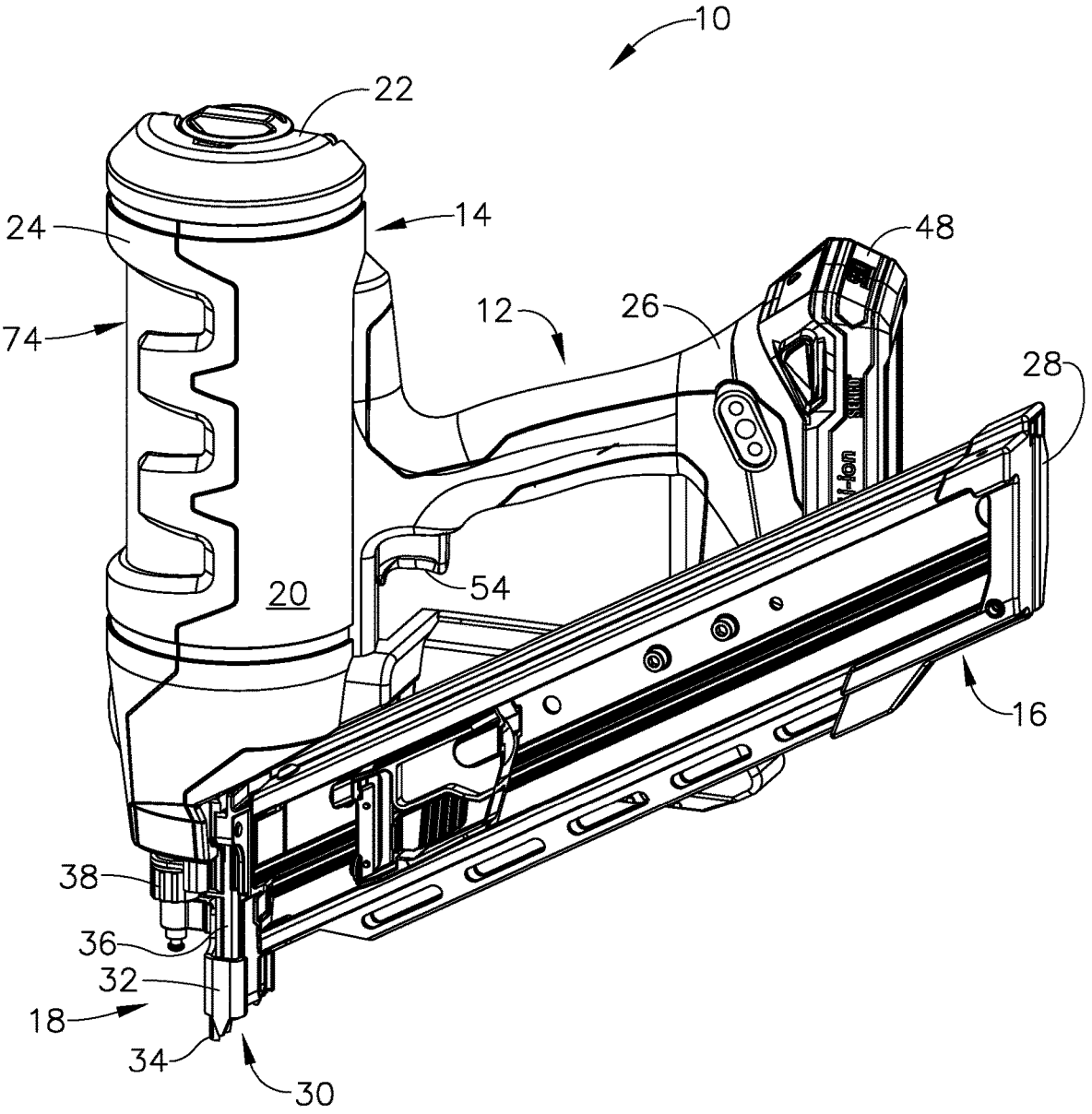
FIG. 1 is a side view of a fastener driving tool, constructed according to the principles of the technology disclosed herein.

Reference will now be made in detail to the present preferred embodiment, an example of which is illustrated in the accompanying drawings, wherein like numerals indicate the same elements throughout the views.

It is to be understood that the technology disclosed herein is not limited in its application to the details of construction and the arrangement of components set forth in the following description or illustrated in the drawings. The technology disclosed herein is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

The terms "first" and "second" preceding an element name, e.g., first inlet, second inlet, etc., or first pin, second pin, etc., are used for identification purposes to distinguish between similar or related elements, results or concepts, and are not intended to necessarily imply order, nor are the terms "first" and "second" intended to preclude the inclusion of additional similar or related elements, results or concepts, unless otherwise indicated.

In addition, it should be understood that embodiments disclosed herein include both hardware and electronic components or modules that, for purposes of discussion, may be illustrated and described as if the majority of the components were implemented solely in hardware.

However, one of ordinary skill in the art, and based on a reading of this detailed description, would recognize that, in at least one embodiment, the electronic based aspects of the technology disclosed herein may be implemented in software. As such, it should be noted that a plurality of hardware and software-based devices, as well as a plurality of different structural components may be utilized to implement the technology disclosed herein. Furthermore, if software is utilized, then the processing circuit that executes such software can be of a general purpose computer, while fulfilling all the functions that otherwise might be executed by a special purpose computer that could be designed for specifically implementing this technology.

It will be understood that the term "circuit" as used herein can represent an actual electronic circuit, such as an integrated circuit chip (or a portion thereof), or it can represent a function that is performed by a processing device, such as a microprocessor or an ASIC that includes a logic state machine or another form of processing element (including a sequential processing device). A specific type of circuit could be an analog circuit or a digital circuit of some type, although such a circuit possibly could be implemented in software by a logic state machine or a sequential processor. In other words, if a processing circuit is used to perform a desired function used in the technology disclosed herein (such as a demodulation function), then there might not be a specific "circuit" that could be called a "demodulation circuit;" however, there would be a demodulation "function" that is performed by the software. All of these possibilities are contemplated by the inventors, and are within the principles of the technology when discussing a "circuit."

Reference will now be made in detail to the present preferred embodiment of the technology, an example of which is illustrated in the accompanying drawings, wherein like numerals indicate the same elements throughout the views.

Referring now to FIG. 1, a first embodiment of a fastener driving tool is generally designated by the reference numeral 10. This tool 10 is mainly designed to linearly drive fasteners such as nails and staples. Tool 10 includes a handle portion 12, a fastener driver portion 14, a fastener magazine portion 16, and a fastener exit portion 18.

A "left" outer housing portion of the driver portion is indicated at 20. A "top" outer housing portion is indicated at 22, while a "front" outer housing portion of the driver portion is indicated at 24. A "rear" outer housing portion for the handle portion is indicated at 26, while a "rear" cover of the magazine portion is indicated at 28. It will be understood that the various directional nomenclature provided above is with respect to the illustration of FIG. 1, and the first embodiment fastener driving tool 10 can be used in many other angular positions, without departing from the principles of this technology.

The area of the tool 10 in which a fastener is released is indicated approximately by the reference numeral 30, which is the "bottom" of the fastener exit portion of tool 10. Before the tool is actuated, a safety contact element 32 extends beyond the bottom 30 of the fastener exit, and this extension of the safety contact element is depicted at 34, which is the bottom or "front" portion of the safety contact element.

Other elements that are depicted in FIG. 1 include a guide body 36 and a depth of drive adjuster 38, which are in mechanical communication with the magazine portion 16.

The fastener driving tool 10 also includes a motor 40 (see FIG. 11) which acts as a prime mover for the tool, and which has an output that drives a gearbox 42. An output shaft of the gearbox drives a gear train leading to a lifter drive shaft 102 (see FIG. 11). A battery pack 48 is attached near the rear of the handle portion 12, and this battery provides electrical power for the motor 40 as well as for a control system.

A printed circuit board that contains a controller is generally designated by the reference numeral 50, and is placed within the handle portion 12 in this embodiment. A trigger switch 52 is activated by a trigger actuator 54. The handle portion 12 is designed for gripping by a human hand, and the trigger actuator 54 is designed for linear actuation by a person's finger while gripping the handle portion 12. Trigger switch 52 provides an input to the control system 50. There are also other input devices used with the system controller, however those input devices are not seen in FIG. 1.

Figure 10:
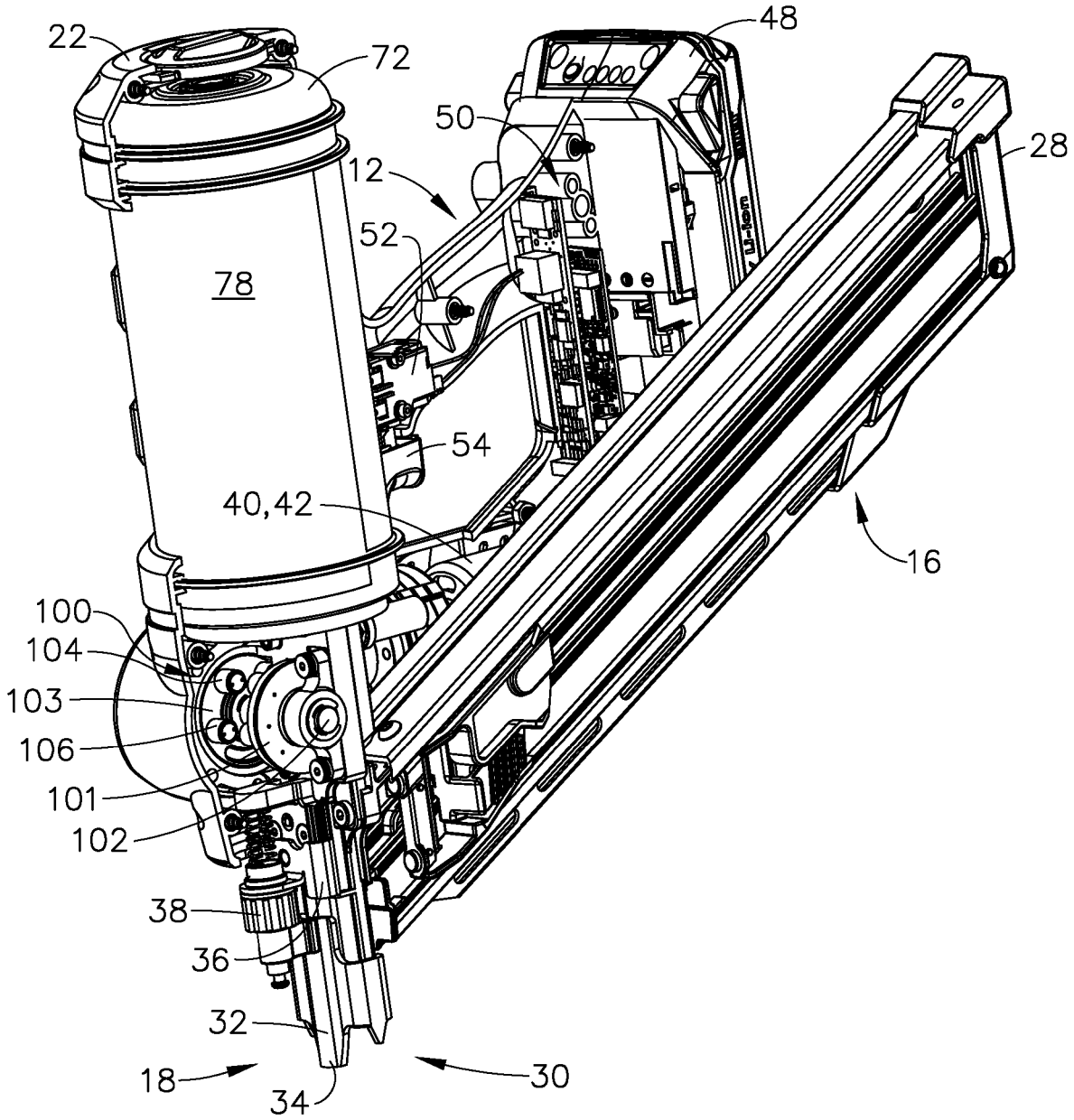
FIG. 10 is a perspective view mostly from the side, showing the fastener driving tool of FIG. 1 with some of the housing removed to expose the final drive portions along the guide body, and showing the electronics.

FIG. 10 illustrates the tool 10 with some of the portions of the housing missing. Therefore, the printed circuit board shows the system controller 50 as it sits inside the handle portion 12 of the tool. The battery pack 48 is attached to the very back portion of the handle, just behind the printed circuit board 50.

Figure 12:
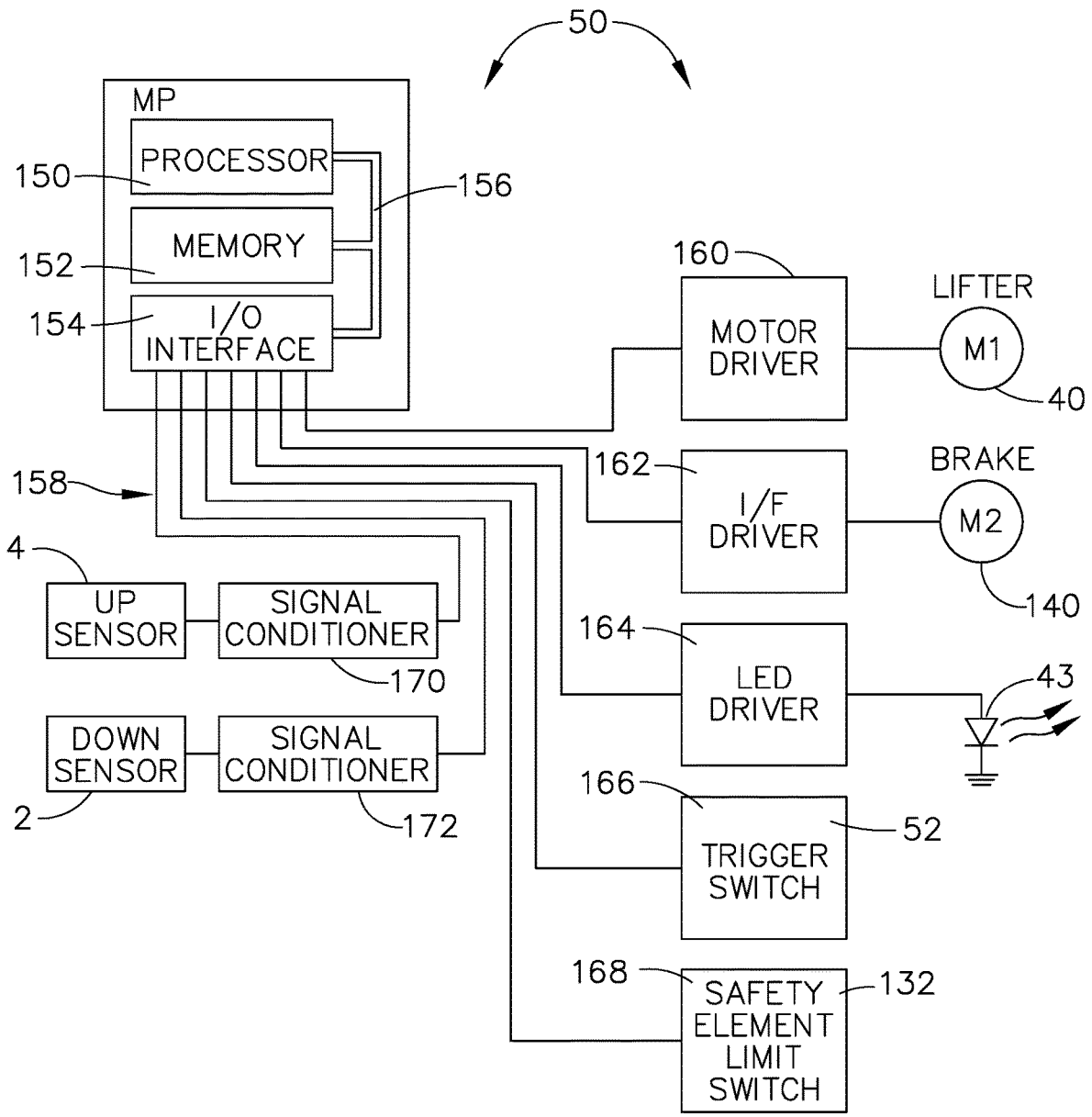
FIG. 12 is a block diagram showing some of the major electronic and electrical components for the fastener driving tool of FIG. 1.

Referring now to FIG. 12, the tool's system controller will typically include a microprocessor or a microcomputer integrated circuit 150 that acts as a processing circuit. At least one memory circuit 152 will also typically be part of the controller, including Random Access Memory (RAM) and Read Only Memory (ROM) devices. To store user-inputted information (if applicable for a particular tool model), a non-volatile memory device would typically be included, such as EEPROM, NVRAM, or a Flash memory device.

The processing circuit 150 communicates with external inputs and outputs, which it does by use of an input/output interface circuit 154. The processing circuit 150, memory circuit 152, and the interface (I/O) circuit 154 communicate with one another via a system bus 156, which carries address lines, data lines, and various other signal lines, including interrupts.

I/O circuit 154 has the appropriate electronics to communicate with various external devices, including input-type devices, such as sensors and user-controlled switches, as well as output-type devices, such as a motor and indicator lamps. The signals between the I/O interface circuit 154 and the actual input and output devices are carried by signal pathways, typically a number of electrical conductors, grouped under the general designation 158.

Some of the output devices include a lifter motor 40 (also referred to as "M1"), a brake circuit 140 (also referred to as "M2"), and a light emitting diode 43, which could potentially be replaced with an audio output device, such as a Sonalert. Each of the output devices will typically have a driver circuit, such as a motor driver circuit 160 for the lifter motor 40, and an interface driver 162 for the brake circuit 140. The position of a latch (not shown) is controlled by an electromechanical device, such as a solenoid or a motor, as desired by the system designer.

The LED 43 would typically have an LED driver circuit 164, which could be a dual-direction driver circuit if the LED was a bi-directional device. Such a device might be desirable, and red and green LEDs are common devices, in which current in a first direction will produce a red indicator lamp signal, while reversing the current would produce a green indicator lamp signal.

The input devices for tool 10 can include various sensors, including a trigger switch 52 and a safety contact element switch 132. If the switches 52 and 132 are standard electromechanical devices (such as limit switches), then typically no driver circuit is necessary. However, if the trigger switch and safety element switch were to be replaced by solid state sensing elements, then some type of interface circuit could be needed, and those are illustrated on FIG. 12 by the reference numerals 166 and 168, respectively.

The tool 10 also includes position sensors that can detect certain physical positions of the driver 90. As briefly discussed above, these sensors are referred to as the "UP sensor," generally designated by the reference numeral 4, and the "DOWN sensor," generally designated by the reference numeral 2. As noted above, it is desired that these two sensors are "non-contact" devices, and in the illustrated embodiment, these two sensors are optical sensors, each one having a light-emitting lamp and a light-sensitive detecting element. Each of these sensors will require some type of signal conditioning circuit, and for the UP sensor 4 the signal conditioner is designated 170, and for the DOWN sensor 2, the signal conditioner circuit is designated 172.

For use with this fastener driving tool 10, the light emitting portions of the UP and DOWN sensors are separated physically from the photo-detecting portions. An exemplary embodiment of tool 10 may use a set of infrared emitting and detecting devices, such as for example: an Everlight 3 mm Infrared LED, part number IR204C/H16/L10 as the light emitter (sold by Everlight Electronics Company, LTD. of New Taipei City, Taiwan); and a LITE-ON phototransistor as the light receiver (photodetector), part number LTR-4206E (sold by LITE-ON Technology Corp. of New Taipei City, Taiwan).

Figure 6:
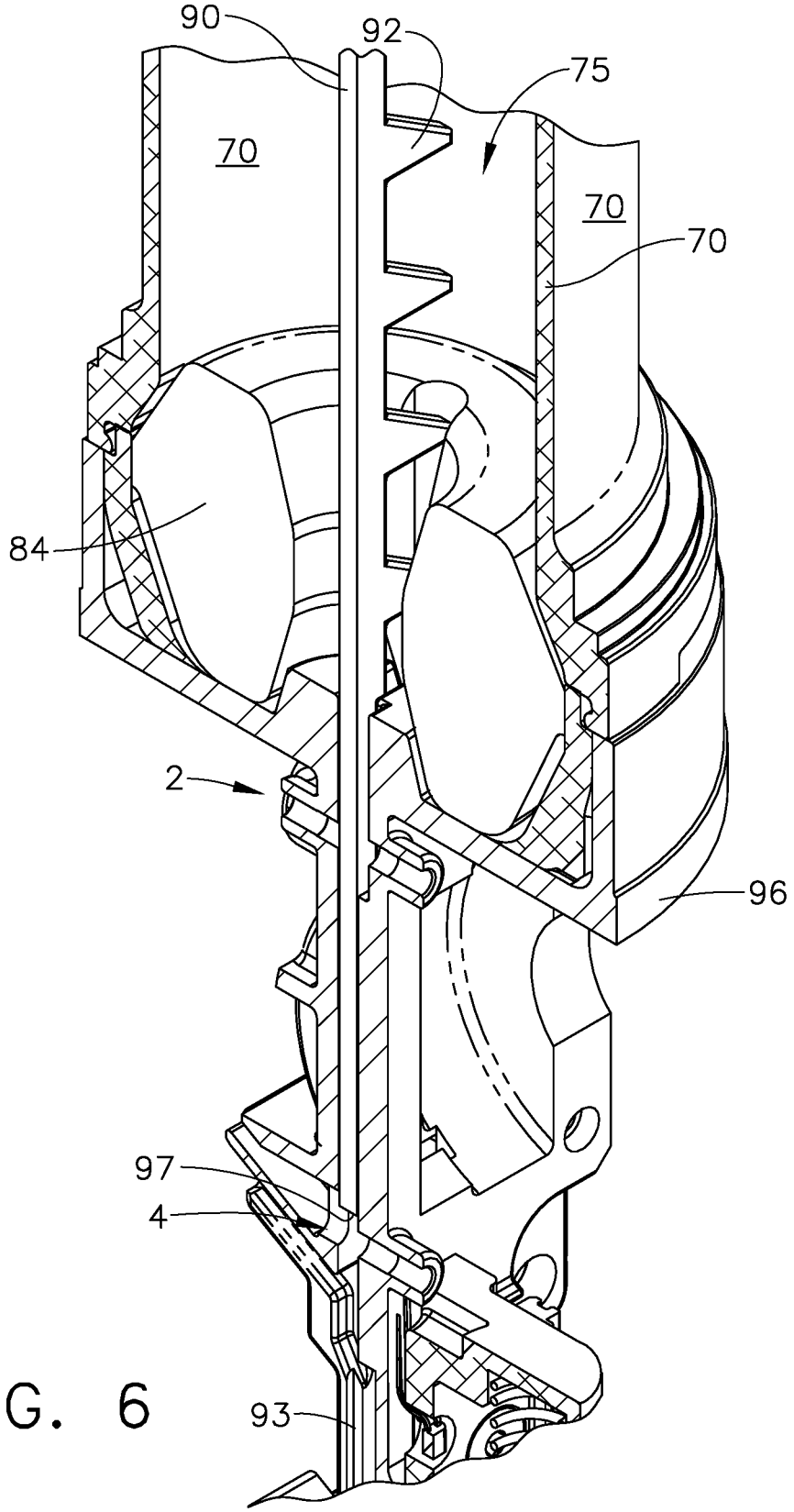
FIG. 6 is a perspective view from above and from the side, in partial cross-section, showing the mid-portion of the cylinder and guide body portions along the drive track of the fastener driving tool of FIG. 1, with the driver in its "up" or "ready" position.
Figure 7:
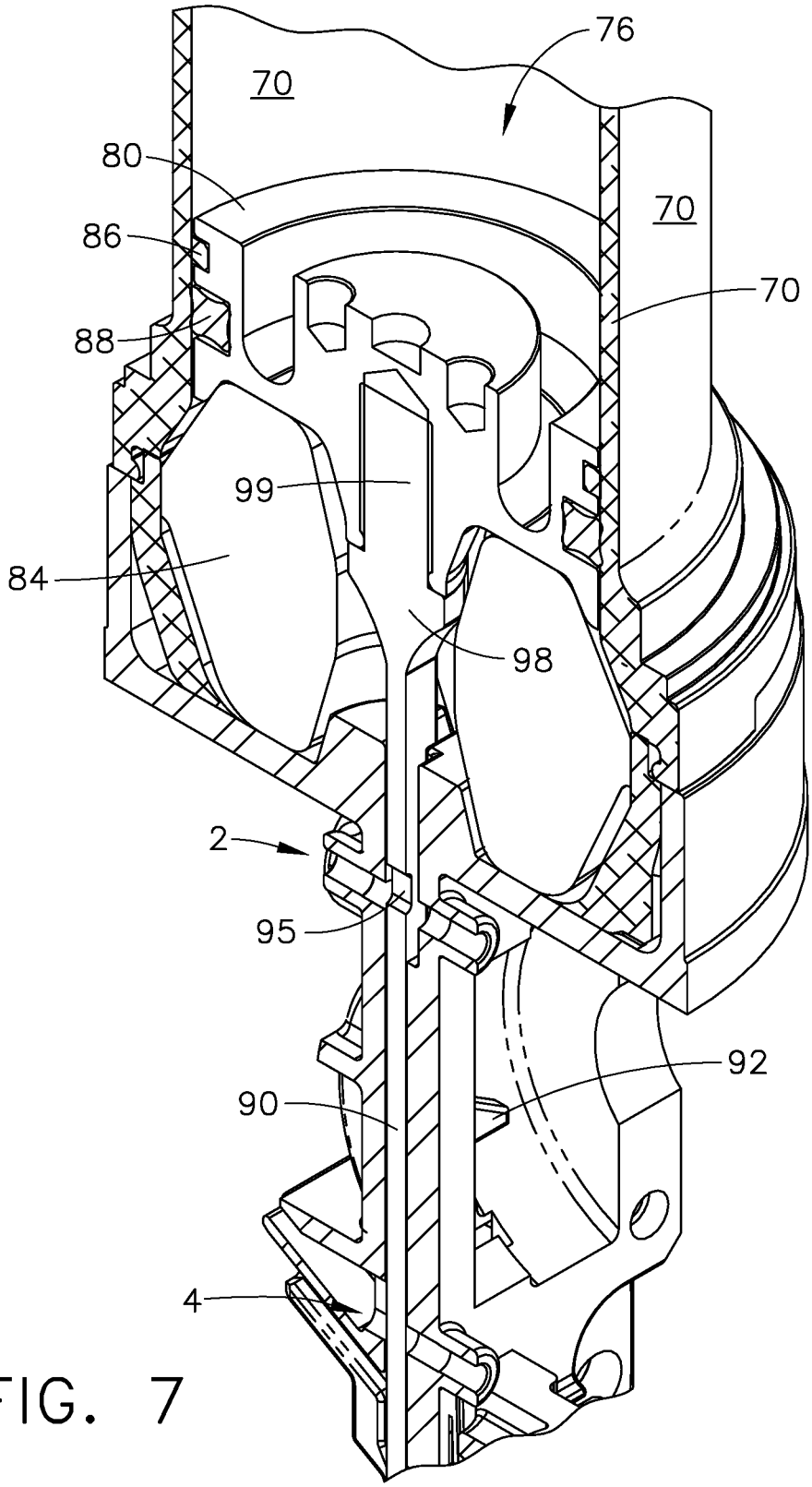
FIG. 7 is a perspective view from above and from the side, in partial cross-section, showing the mid-portion of the cylinder and guide body portions along the drive track of the fastener driving tool of FIG. 1, with the driver in its "bottom" or "driven" position.

These position sensors 2 and 4 are to be located in small cylindrical areas near the driver track (see FIGS. 6 and 7). On one side of the driver track will be the LED portion of the sensor, and on the opposite side of the driver track will be the photodetector portion of the sensor. In this manner, if the driver 90 happens to be positioned so that its metal body is between the LED and the photodetector of one of these UP or DOWN sensors, then the light will be intercepted and will not reach the photodetector. On the other hand, if the driver 90 has been moved to a different position such that there is no blockage between the LED and the photodetector, then of course the light will reach the photodetector. This will be described in greater detail below.

It will be understood that the type of position sensor can be changed to a different type of proximity-sensing device, such as a magnet-sensing proximity sensor, or even a color-sensing device. If a Hall-effect sensor was to be used, for example, then the "target area" on the driver probably would not be a through-hole, but instead a small magnet would be used as a "detection zone." Electromechanical limit switches could also be used as position sensors, but in this engineering application, it is preferred that a non-contact sensor be used, as noted above.

As an example, if a magnet-sensing proximity sensor was used, such as a Hall-effect sensor, for the position sensor(s), then a small magnet could be installed along one of the longitudinal edges of the driver 90, perhaps at the junction (or corner) of one of the protruding teeth 92 and the main body (or face) of the driver. The position sensor would then be mounted along the driver track very near that portion of the driver track that is near (proximal) to that side of the driver, as it passes by.

Additional input and output devices could be included with the fastener driving tool 10, if desired. For example, a small display could be added, to show certain information about usage or the condition of the tool. However, the indicator light 43 can also be used to show the system status for a small number of various conditions. Other types of sensing devices or output devices could also be added, if desired by the system designer, without departing from the principles of the technology disclosed herein.

Figure 2:
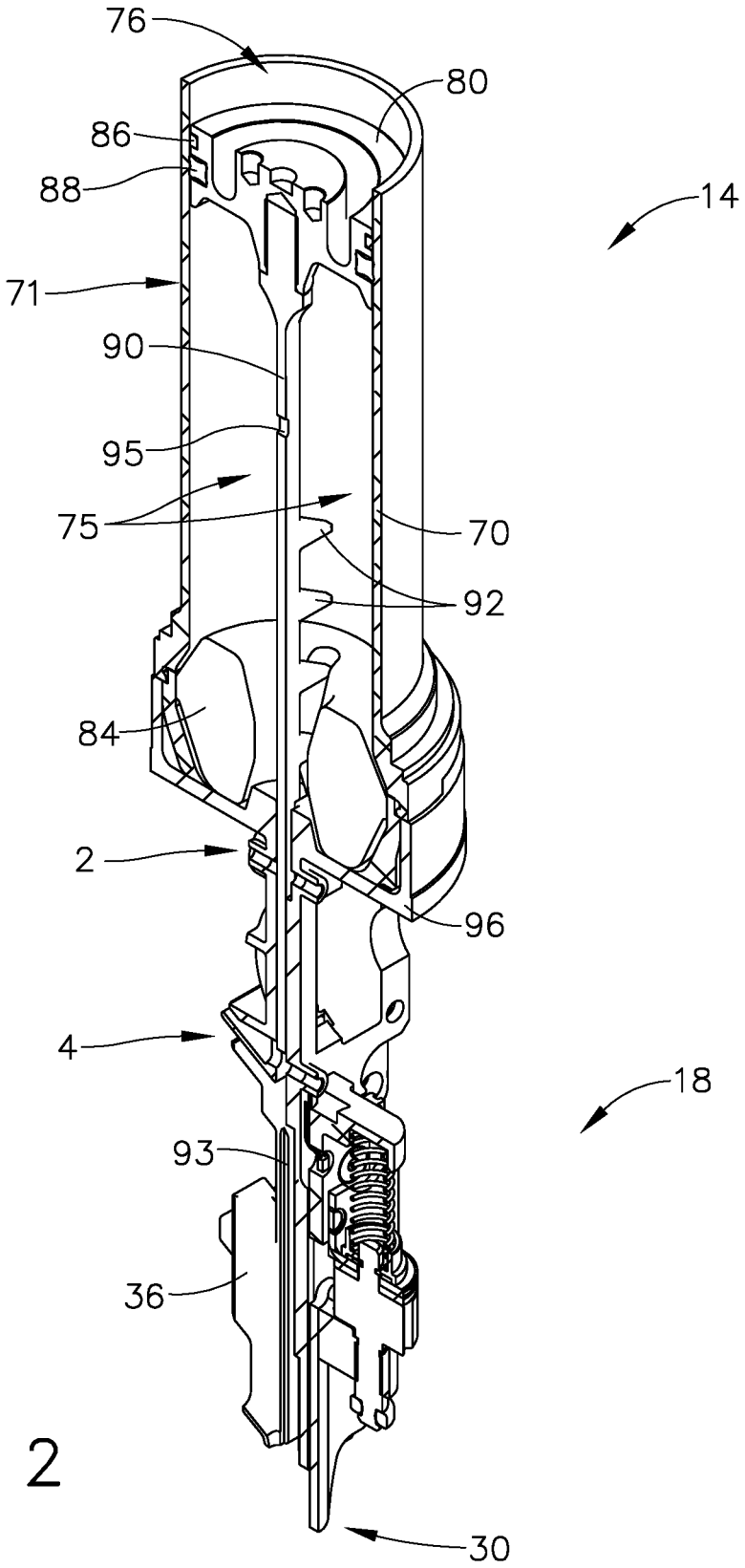
FIG. 2 is a perspective view from the side and above, in partial cut-away, showing the gas spring cylinder mechanism of the fastener driving tool of FIG. 1.

Referring now to FIG. 2, a working cylinder subassembly is designated by the reference numeral 71, and this is included as part of the fastener driver portion 14. On FIG. 2, the working cylinder 71 includes a cylinder wall 70, and within this cylinder wall 70 is a piston 80, and a stationary piston stop 84. Part of the piston mechanism of this embodiment includes a piston seal 86 and a piston guide ring 88. Surrounding, in the illustrated embodiment, the cylinder wall 70 is a main storage chamber 74 (also sometimes referred to herein as a "pressure vessel storage space") and an outer pressure vessel wall 78 (which is beneath the "front" cover 24 of FIG. 1). At the top (as seen on FIG. 10) of the fastener driver portion 14 is a top cap 72 for the cylinder mechanism.

Also within the fastener driver portion 14 are mechanisms that will actually drive a fastener into a solid object. This includes a driver 90, a cylinder "venting chamber" 75 (which would typically always be at atmospheric pressure), a driver track 93 (see also FIG. 6), a rotary-to-linear lifter 100, and the latch (not shown). The driver 90 is also sometimes referred to herein as a "driver member" and the rotary-to-linear lifter 100 is also sometimes referred to herein as a "lifter member," or simply as a "lifter."

Figure 4:
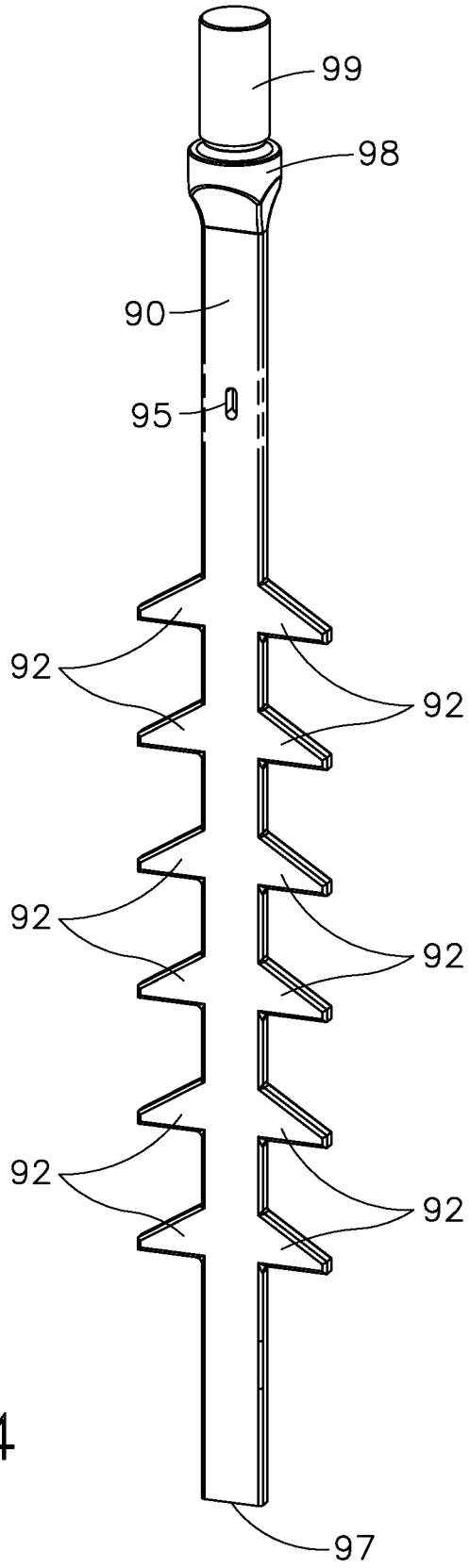
FIG. 4 is a perspective view mainly from the side, of the entire driver member of the fastener driving tool of FIG. 1.

Driver 90 is rather elongated, and as an individual element can best be seen in FIG. 4. The main body of its elongated face is substantially rectangular. There are multiple protrusions or "teeth" 92 that are positioned along the longitudinal edges of the driver. In the illustrated embodiment, these teeth 92 protrude in a transverse direction from the longitudinal centerline of driver 90, and they are spaced-apart from one another along the outer longitudinal edges of the driver 90. The positions of teeth 92 are clearly illustrated in FIG. 4. It will be understood that the precise positions for the teeth 92 could be different from those illustrated for the driver 90 without departing from the principles of the technology disclosed herein.

The latch (not shown) is designed to "catch" the driver 90 at times when the driver should not be allowed to move through an entire "driving stroke." The latch has a catching surface that can intercept a tooth 92 of the driver 90, when the latch is moved to its engaged, or "interfering" position. When a driving stroke is to occur, the latch is pivoted so that its catching surface is moved to its "disengaged" position, which is out of the way of the driver, and thus its catching surface will not interfere with any of the driver's teeth 92. An exemplary embodiment of such a latch is fully described in U.S. Pat. No. 8,011,441, owned by Senco Brands, Inc., which is incorporated herein by reference in its entirety.

There is a cylinder base 96 that mainly separates the gas pressure portions of the fastener driver portion 14 from the lower mechanical portions of that driver portion 14. The portion of the variable volume that is below the piston 80 is also referred to as a cylinder venting chamber 75, which is vented to atmosphere via a vent (not shown) in the cylinder base 96. The lower mechanical portions of driver portion 14 include a rotary-to-linear lifter 100 which was briefly mentioned above, along with a lifter drive shaft 102. Drive shaft 102 protrudes through the center portions of the fastener driver portion 14 and through the center of the lifter 100, and this shaft is used to rotate the lifter, as desired by the control system (see FIGS. 10 and 11).

In FIG. 2, the piston 80 is not quite at its uppermost or top-most position, and a gas pressure chamber 76 can be seen above the top-most area of the piston, above the piston seal 86. It will be understood that the gas pressure chamber 76 and the main storage chamber (or storage space) 74 are in fluidic communication with one another. It will also be understood that the portion to the interior of the cylinder wall 70 forms a displacement volume that is created by the stroke of the piston 80. In other words, the gas pressure chamber 76 is not a fixed volume, but this chamber will vary in volume as the piston 80 moves up and down (as seen in FIG. 2). This type of mechanical arrangement is often referred to as a "displacement volume," and that terminology will mainly be used herein for this non-fixed volume 76.

It will be further understood that the main storage chamber 74 preferably comprises a fixed volume, which typically would make it less expensive to manufacture; however, it is not an absolute requirement that the main storage chamber actually be of a fixed volume. It would be possible to allow a portion of this chamber 74 to deform in size and/or shape so that the size of its volume would actually change, during operation of the tool, without departing from the principles of the technology disclosed herein.

In the illustrated embodiment for the first embodiment fastener driving tool 10, the main storage chamber 74 substantially surrounds the working cylinder 71. Moreover, the main storage chamber 74 is annular in shape, and it is basically co-axial with the cylinder 71. This is a preferred configuration of the illustrated first embodiment, but it will be understood that alternative physical arrangements could be designed without departing from the principles of the technology disclosed herein.

The illustrated embodiment for the fastener driving tool 10 is similar to earlier such tools sold by Senco Brands, Inc. However this new tool is more powerful, and is designed as a framing nailer device. The earlier devices, often referred to as FUSION® have been available for years from Senco, and those tools were generally classified as "finishing nailers." Both types of tools have a lifting mechanism that pushes the driver back up (i.e., the direction "up" being in reference to the presentation on the figures herein) to its "ready" position. This lifting movement is against a pressurized cylinder that also has a storage volume containing the pressurized gasses, and as the piston and driver combination are moved upward, the pressure only builds in intensity, thereby making it more difficult to lift the piston/driver combination. With these requirements in mind, the lifter mechanism must be both mechanically strong and powerful, but also robust.

One potential problem with this type of mechanism is the possibility of the driver stopping at a position that is out of specification, and if that occurs, the lifter may have trouble engaging the driver teeth, such that the driver cannot be properly lifted back to its ready position. In some situations, the driver ends up in a position in which the mechanical "pins" of the lifter end up impacting directly against the driver teeth 92, and in that situation, these mechanical components can jam together; and under more severe conditions, the rotary motion of the lifter pins impacting the driver teeth sometimes can actually break the driver at the point of contact.

Figure 3:
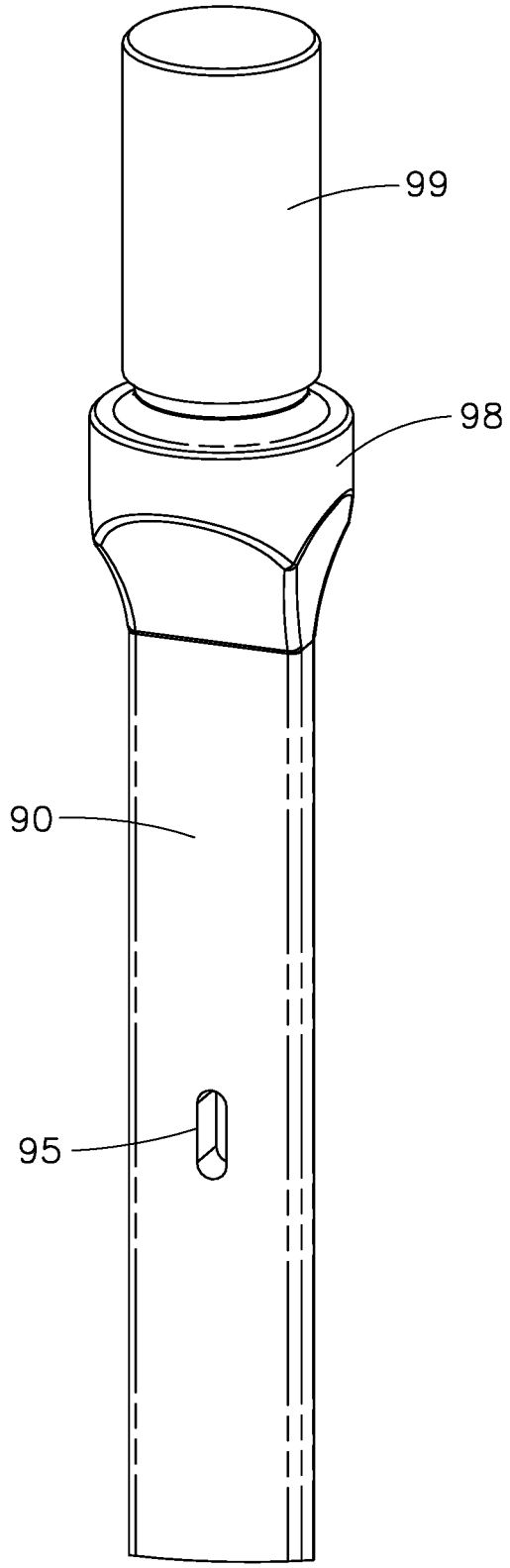
FIG. 3 is a perspective view from the side of a portion of the driver member of the fastener driving tool of FIG. 1.

In view of these potential operating conditions that can be out of specification, the driver 90 has been designed with an opening 95 in the mid-portion of the elongated face of the driver. Referring now to FIG. 3, the top-portion of the driver 90 is illustrated, showing the opening 95 in the mid-portion of the elongated driver. The very top portion of the driver 90 is a cylindrical post 99, which attaches to the piston 80, thereby putting these two members in mechanical communication and making the driver 90 move directly with motions of the piston 80. Beneath that is an enlarged portion 98 that provides a mechanically robust connection and tapers down to the relatively thin "blade-like" shape of the elongated driver's main body.

Figure 8A:
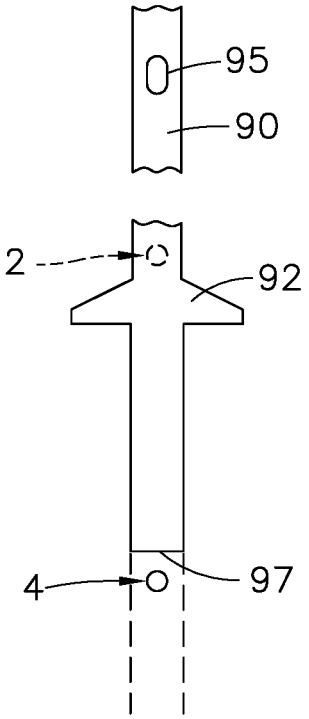
FIGS. 8A and 8B show portions of the driver member in a side view, both before and after the driver has been moved from its ready position to its driven position, for a driver used in a framing tool, such as the tool of FIG. 1.
Figure 8B:
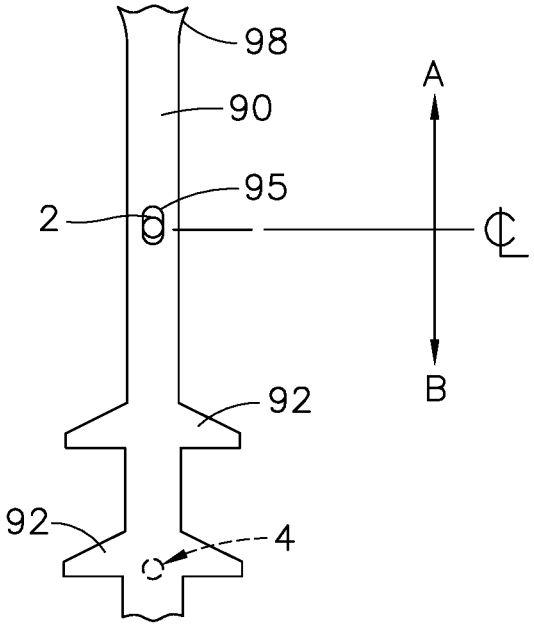

The opening 95 is illustrated as an oval, which is a preferred shape for this opening, rather than a circle. Of course, other shapes could be used, such as a rectangle, although that would be more difficult to machine than the oval that is illustrated in FIG. 3. An appropriate size of opening 95, for the framing nailer device depicted in FIGS. 8A and 8B, is about 0.060 inches by 0.120 inches.

Referring now to FIG. 4, the entire driver 90 is illustrated, again showing the top post 99 and enlarged portion 98, as well as the mid-portion opening 95 in the driver's face. In this illustrated embodiment of FIG. 4, there are six protruding teeth 92 along each of the two longitudinal edges of the driver main-portion 90. The bottom edge of the driver is designated by the reference numeral 97, and that is the portion that will impact against a fastener that is to be driven into a workpiece. The multiple teeth 92 (which are also referred to as "protrusions" herein), are spaced-apart at an appropriate distance to allow the lifter pins 104, 106, 108, and so on to fit between the spaces along the longitudinal edges of the driver 90, both between the various lifter teeth 92 but also of the correct size so as to "mate" with those pins such that the rotary motion of the lifter will cause those pins to push the driver 90 upward, during a lift stroke. This, of course, is designed to move the driver/piston combination from its bottom "driven" position, back toward its upper "ready" position.

The rotary-to-linear lifter 100 also includes several cylindrical protrusions (or "extensions") that will also be referred to herein as "pins." A first such pin ("pin 1") is designated 104, a second pin ("pin 2") is designated 106, while a third pin ("pin 3") is designated 108. Furthermore, there are additional cylindrical pins that protrude from the opposite disk of the lifter 100. As rotary-to-linear lifter 100 rotates counterclockwise (as seen in FIG. 10) at least one of its pins 104, 106, or 108 will come into contact with one of the teeth 92 along the longitudinal edge of the driver 90. This will cause the driver 90 to be "lifted" upward (as seen in FIG. 3). As the lifter 100 rotates, one of the teeth 92 will be in contact with one of the rotating pins 104, 106, 108 throughout a portion of the rotational travel of the lifter, and the "next" pin will then come into contact with the "next" tooth 92 so that the driver 90 continues to be moved upward.

Figure 5:
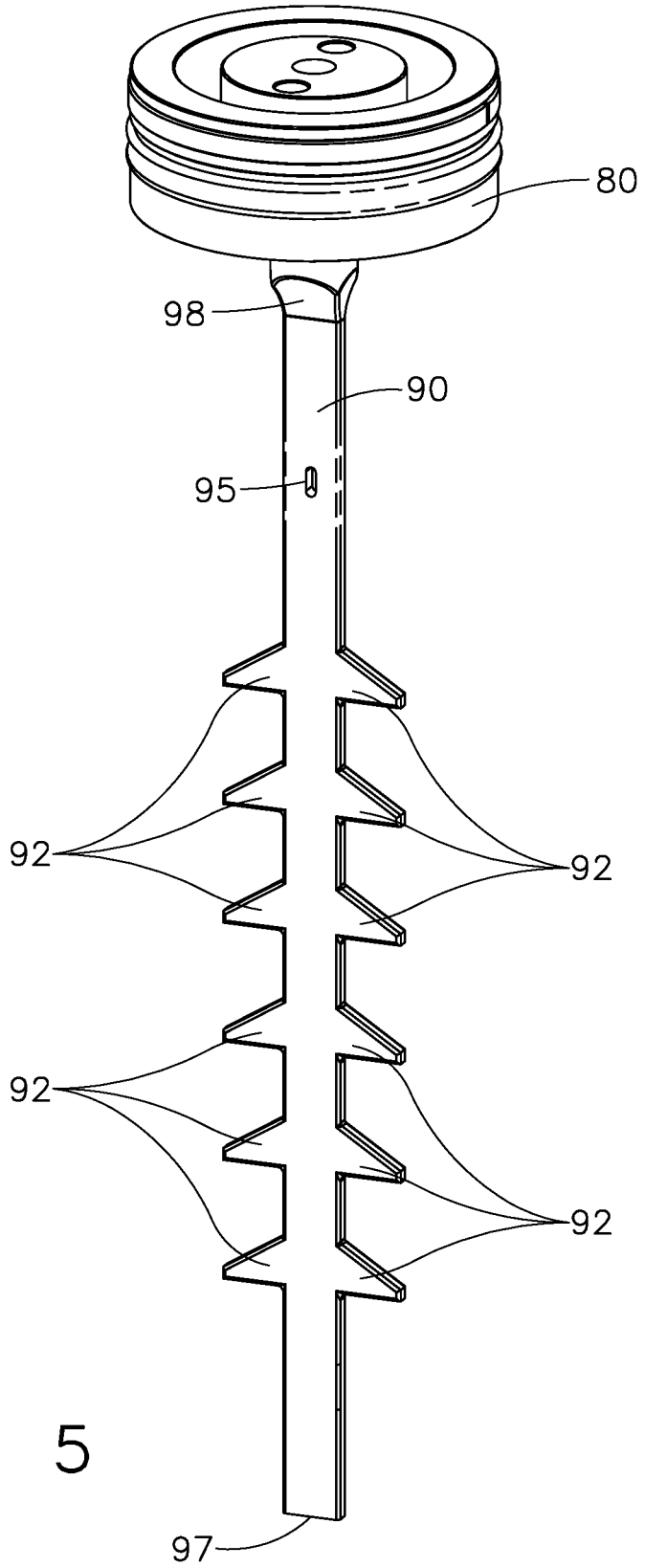
FIG. 5 is a perspective view mainly from the side, showing the combination of the driver member and the piston, of the fastener driving tool of FIG. 1.

Referring now to FIG. 5, the driver/piston combination is illustrated as a subassembly. The driver 90 is attached to the piston 80 near the top or upper portion of the driver, as seen in this view. It will be understood that the fastener driving tool 10 can be utilized at various angles and positions, and therefore the terminology "up" or "down", or "top" or "bottom", refers to the orientation as illustrated in these drawings.

Referring now to FIG. 6, the mid-portion of the fastener driving tool 10 is illustrated in a section view, showing the inner workings of the pressurized cylinder and a portion of the driver track 93. In this view, the driver 90 is depicted at its "ready" position, which is near the top of its possible travel throughout the driver track 93. Several of the protruding driver teeth 92 are illustrated in FIG. 6, as is the (variable volume) cylinder venting chamber 75, which is inside the cylinder wall 70. The piston stop 84 is illustrated at the bottom within the overall driving cylinder subassembly, and the cylinder base 96 is indicated.

FIG. 6 illustrates two essentially horizontal cylindrical openings at the reference numerals 2 and 4. These are the positions where the UP sensor and DOWN sensor are to be placed within the fastener driving tool 10. The UP sensor 4 is actually below the DOWN sensor 2 in this embodiment, which seems counterintuitive, but one must understand the reasoning for this terminology. The main purpose of the DOWN sensor 2 is to provide an indication as to when the driver 90 has reached its "down" or nominal lower position, which is also referred to herein as the "driven" position. The main purpose of the UP sensor 4 is to provide an indication as to when the driver 90 has nearly reached its upper or "ready" position. As can be seen on FIG. 6, the bottom edge 97 of the driver 90 is just a little above the position of the UP sensor 4. Therefore, when the driver 90 is in the position as illustrated on FIG. 6, the UP sensor will detect that it actually is in that "UP" position, hence the name given this sensor 4. As will be discussed below, the DOWN sensor 2 is in an appropriate position to detect when the driver 90 is at its nominal "DOWN" position.

Referring now to FIG. 7, the same mid-portion of the fastener driving tool 10 is illustrated in a cut-away view, this time with the driver 90 at its lower or "driven" position. In this view, the top portion of the piston 80 is visible, and the (variable volume) gas pressure chamber 76 is now visible, because it is always above the top portion of the piston. This gas pressure chamber 76 is part of the variable displacement volume of the fastener driving tool. In FIG. 7, the piston 80 is depicted at its bottom-most travel position, and in this configuration, the displacement volume 76 and the main storage chamber 74 are at their largest combined volumes, while the cylinder venting chamber 75 is at its minimum (near zero) volume.

It can be seen in FIG. 7 that the driver main body portion is now extended through the cylindrical openings of where the UP sensor 4 is to be positioned. Therefore, the driver 90 will block any light attempting to pass from one side of that "up" position to the other side. On the other hand, the opening 95 that is in the mid-portion of the elongated driver 90 is now aligned with the DOWN sensor 2. Therefore, light from the LED portion of the DOWN sensor will be able to reach the photodetector portion of the DOWN sensor, thereby allowing the DOWN sensor to successfully detect this driver position, after the driver has finished a drive stroke and has ended up at its nominal "driven" position.

This depiction of FIG. 7 is, of course, showing the driver 90 having finished its driving event at a correct, "within specification," position. The length of the oval shape of the opening 95 provides a small tolerance to allow the driver 90 to not be required to have a truly precise ending position to be within specification. This allows some wear of the piston stop 84 before the driver 90 would end up being too low in the driver track, and this also provides both a plus and minus tolerance of mis-position of the driver 90 that can be tolerated for a successful lift thereafter, when the lifter pins engage the protrusions 92 of the driver 90. With this in mind, the size and shape of the mid-portion opening 95 in the face of driver 90 can be precisely controlled, as desired.

In the configuration depicted on FIG. 7, the fastener driving tool 10 has been used to drive a fastener, and the tool now must cause the driver 90 to be "lifted" back to its top-most position for a new driving stroke. This is accomplished by rotating the lifter 100, which is actuated by the motor 40, through its gearbox 42, etc.

Referring now to FIG. 8A, a diagram is provided showing the relative positions of the UP and DOWN sensors (4 and 2) with respect to the driver 90, when the driver is at its "ready" position. As can be seen, the UP sensor 4 is uncovered by the elongated driver 90, and in particular, the lower-most edge 97 of the driver is located somewhat above the position of the UP sensor 4. The DOWN sensor 2, shown in broken lines, is clearly blocked by the overall elongated shape of the driver 90. The opening 95 of the driver is not in any position to allow light to pass from the LED to the photodetector of the DOWN sensor 2.

Referring now to FIG. 8B, another diagram shows the relative positions of the UP and DOWN sensors with respect to the driver 90 after the driver has undergone a driving stroke and is now in its "driven" position. In this state, the main face of the driver 90 is clearly blocking any light from reaching the photodetector of the UP sensor 4, which is shown in broken lines. On the other hand, the DOWN sensor 2 is now uncovered by the opening 95, and light will be allowed to pass from the LED to the photodetector of the DOWN sensor.

The centerline of the DOWN sensor is indicated on FIG. 8B, with displacement arrows A and B indicating directions of travel of the driver member 90. FIG. 8B illustrates a nominal situation with a brand new fastener driving tool 10, showing the location where the driver 90 should end up at the end of its driving stroke (at its "driven" position). There is some empty space toward the top of the elongated opening 95, and that is to provide some tolerance to allow the piston stop to undergo wear, while still allowing the fastener driving tool to successfully operate its lifting sequences, so as to lift the driver back to its "ready" position. In other words, the opening 95 has some extra room to allow the driver 90 to end up somewhat lower, i.e., in the direction B, at the end of its driving stroke travel, before becoming out of specification, such that the opening 95 would pass all the way through the desired centerline and end up farther down the driver track in direction B to the extent that it would end up blocking light for the DOWN sensor.

The exact positions and tolerances for these components is up to the system designer, and they can be changed for different embodiments of such fastener driving tools, as desired. The overriding factor is to attempt to prevent a lifting operation to be fully engaged if the driver 90 bottoms out at a position that is out of specification; otherwise, if that lifting operation were to be allowed to proceed, the lifter pins might either jam or break the driver, upon impact by those pins. These operations will be discussed in greater detail below.

Figure 9A:
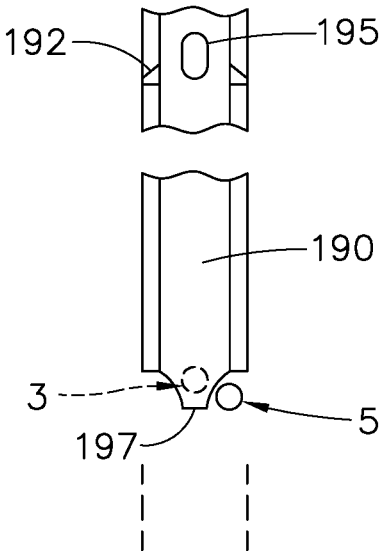
FIGS. 9A and 9B show portions of the driver member in a side view, both before and after the driver has been moved from its ready position to its driven position, for a driver used in a finishing tool.

Referring now to FIG. 9A, a different type of driver member is illustrated, and is generally designated by the reference numeral 190. This type of driver is used in the Senco finishing nailer known as the FUSION® tool. As can be readily discerned by viewing FIG. 9A, the bottom edge 197 of the driver 190 is not a straight line as it was in the case of the framing tool driver 90, having a straight lined edge 97 (as seen on FIG. 8A). This allows the positions of the UP and DOWN sensors to be changed, and in FIG. 9A, the UP sensor is at 5, while the DOWN sensor is at 3. In this embodiment, both sensors are almost at the same elevation in this view. The important thing is that the UP sensor 5 is uncovered by the driver's main body, and the arcuate shape of a portion of the bottom edge 197 allows for that. The protrusions or driver teeth are indicated at the reference numeral 192, and there is a somewhat different shape to the overall width of the driver 190 that also extends most of the way to the outer edge of the driver teeth 192. The elongated opening 195 will be used for detecting the lower or "DOWN" position, after the driver 190 has undergone a driving stroke.

Figure 9B:
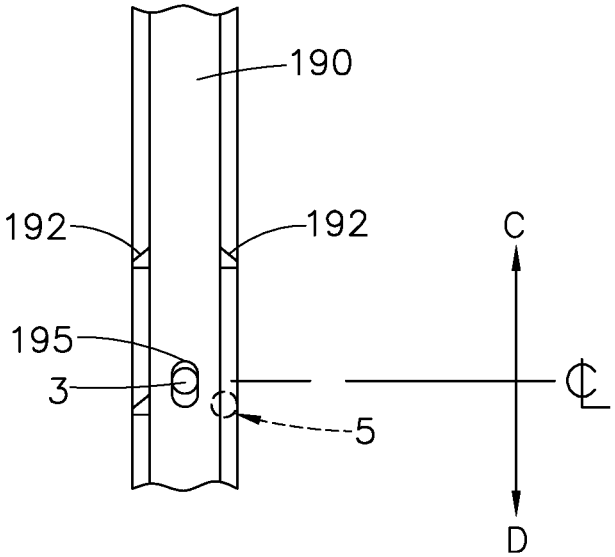

FIG. 9B shows the "DOWN" state of the driver 190, after it has undergone a driving stroke and has been moved to its "driven" position. In this driven state, the UP sensor 5 is now covered by the main body of the driver 190, while the DOWN sensor 3 is now uncovered by the elongated opening 195. The centerline of the DOWN sensor 3 is indicated, as well as the up and down arrows C and D, showing the directions of tolerances that would be available, by the use of the elongated opening 195. The principles of operation for the finishing tool driver 190 of FIGS. 9A and 9B are essentially the same as the principles of operation for the framing tool driver 90 of FIGS. 8A and 8B.

Referring now to FIG. 10, a lifter subassembly 100 is depicted, which includes two parallel disks, designated 101 and 103, which are keyed to a common shaft 102. (As noted above, shaft 102 is driven by the output shaft from the gearbox 42.) The cylindrical lifter pins 104, 106, etc. extend from both of these disks, as seen on FIG. 10. More precisely, the lifter pins 104 and 106 extend from the lifter disk 103, while (as seen on FIG. 11) the lifter pin 108 extends from the lifter disk 101. Both sets of lifter pins extend inward, toward the centerline of the driver 90. This allows the lifter pins to engage both sets of protrusions 92 along both longitudinal edges of the driver blade 90. This provides for equalizing the mechanical loading forces along both sides of the driver 90, and on both of the two lifter disks 101 and 103. Note that, in the illustrated embodiment, there are three lifter pins on each of the lifter disks 101 and 103, for a total of six lifter pins. These pins also have outer rollers.

Figure 11:
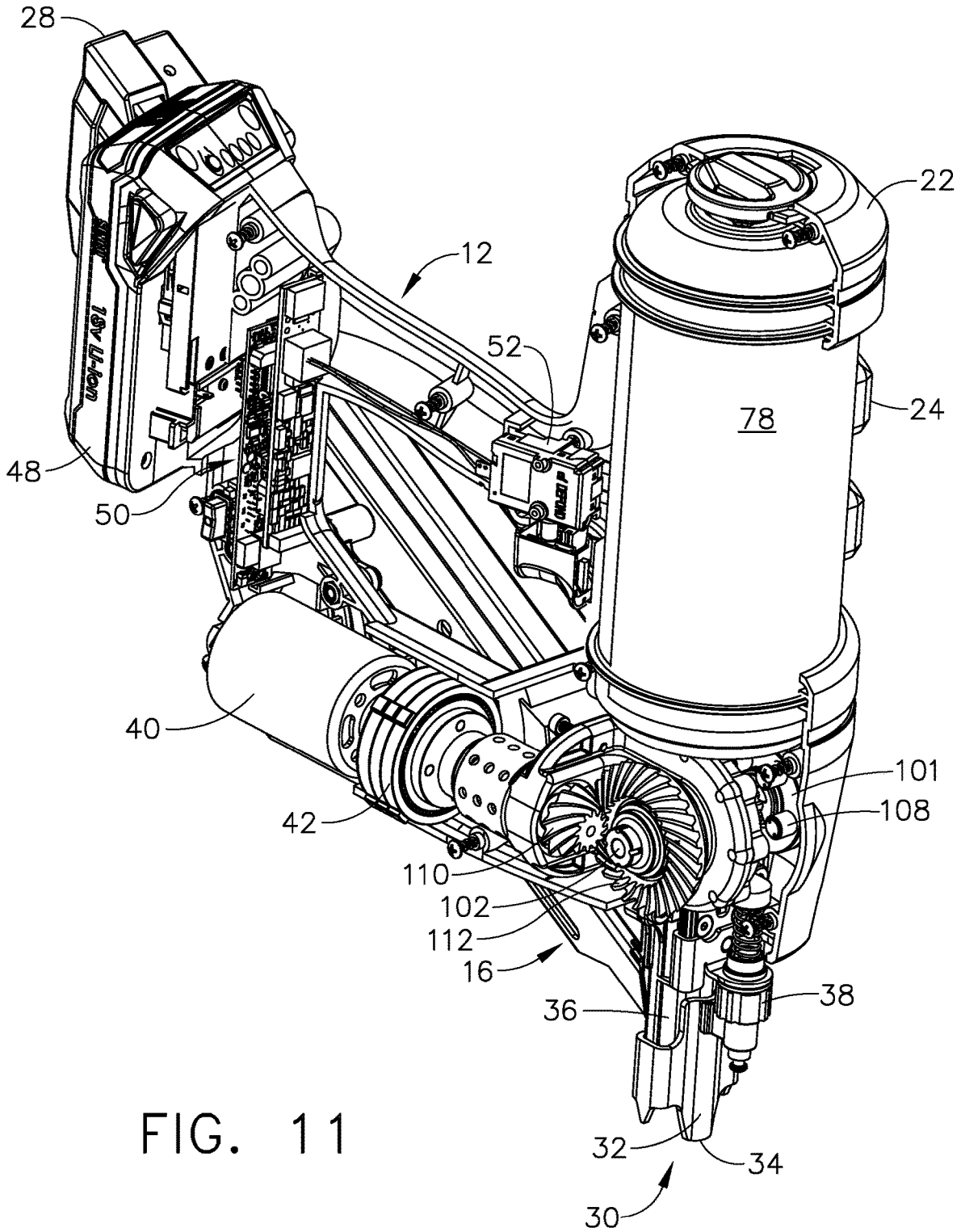
FIG. 11 is a perspective view from the opposite side, showing the fastener driving tool of FIG. 1 with some of the housing removed to expose the final drive portions along the guide body, and showing the electronics.

Referring now to FIG. 11, additional details can be seen with the housing removed of the drive components that are used for lifting the driver from its driven position to its ready position. The drive motor 40 is clearly seen, as is the gearbox 42. This provides rotary motion for a helical gear set, in which the driving gear is designated 110, and its mating driven gear is designated 112. The gear 112 is keyed to the output shaft 102, and both of the lifter disks 101 and 103 are also keyed to that output shaft 102. It can be seen that the motor 40 provides the mechanical impetus for driving the lifter subassembly, which in turn provides a rotary-to-linear motion to cause the driver 90 to be lifted back toward its ready position. The principles of these components is very similar to the original FUSION® fastener driving tool that Senco has been selling for years.

Figure 13:
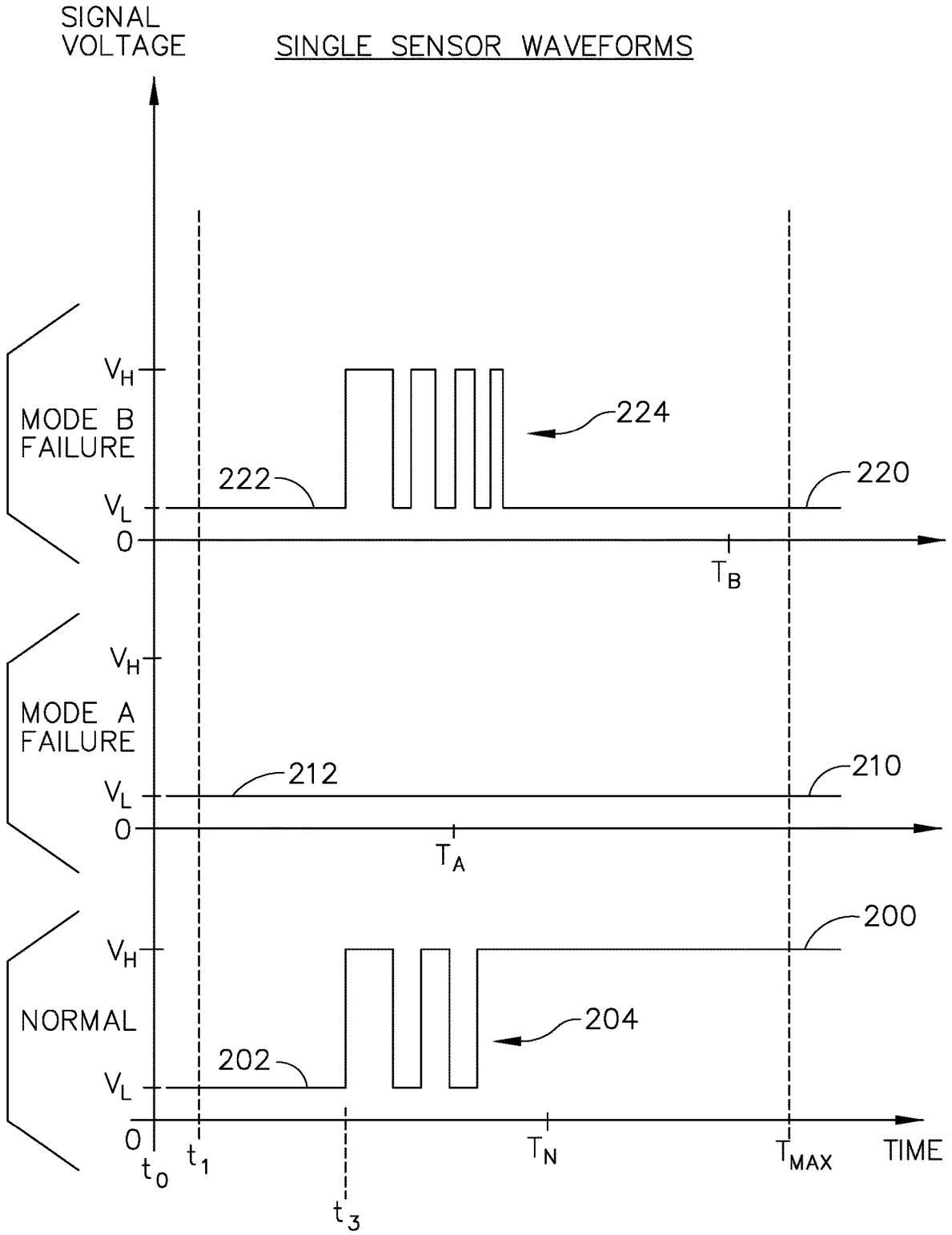
FIG. 13 is a chart showing three waveforms for a single sensor embodiment of the fastener driving tool of FIG. 1.

Referring now to FIG. 13, a set of waveform graphs is provided that shows how the signals are interpreted for the UP and DOWN sensors in various modes of operation. The Y-axis represents signal voltage, and the X-axis represents time. The bottommost graph of FIG. 13 shows a waveform that starts off (at the reference numeral 202) at a low logic state, and then begins transitioning at 204 to a high logic state, where it remains through the remainder of the driving stroke, as indicated at the reference numeral 200. This is a "normal" operation showing a waveform if a single sensor is used in a fastener driving tool of the type described herein.

The term "single sensor" refers to a tool that has only a DOWN sensor, and no UP sensor. This type of tool has not been discussed herein as of yet; such a tool would include a DOWN sensor, but instead of using an UP sensor, the tool must detect (or otherwise determine) the beginning of a driving cycle. In other words, the control system needs to have a "start" signal, so it can then determine the timing of the transitions at the waveform 204, and determine whether or not that timing is correct.

One of the key elements in using a single sensor design is determining when the "start signal" has occurred. This can be done in more than one way. For example, the motor current of motor 40 can be sensed, and a sudden large increase in current would indicate that the lifter motor has been energized to release the lifter pin from the driver teeth, thereby allowing the piston to push the driver downward for a driving stroke. A second possibility is controlled entirely electronically by the controller, because it knows when it provides a gate signal to the motor drive transistor circuit, and that could certainly be used as a "start signal." The combination of the trigger actuation and the safety element being actuated can be used as an indication, if desired. This would be an indirect indicator, but essentially these are the two signals that tell the fastener driving tool that it is time to drive a fastener, so they are the beginning of the process, and could be used as a "start signal," if desired. Another possibility is to include a pressure sensor inside the working cylinder 71, and a sudden decrease in pressure would indicate that the piston and driver are being forced downward, which implies a driving stroke taking place.

In the middle graph of FIG. 13, the waveform starts at 212, at a logic low value, and unfortunately never changes state and ends up at the same logic low value at 210. This would only occur if the driver 90 never made it all the way down the driver track 93 to its normal finishing or "driven" position. The typical cause of that event is some type of mechanical interference, possibly due to a fastener being stuck in the driver track from a previous drive cycle. If that occurs, the driver may become "hung up" partway down the driver track, such that the opening 95 never reaches the correct position in the driver track 93, and therefore, the DOWN sensor never receives any light from its LED. The upshot is that the signal shown on the middle graph of FIG. 13 is the output signal of the DOWN sensor, and it never changes state. This is referred to as a "Mode A" failure. The timing mark along the X-axis referred to as $T_A$ represents the allowable determination time for the controller logic to act, and if a transition has not occurred by time $T_A$, then the brake circuit should be applied.

The top graph on FIG. 13 starts out with the DOWN signal producing a logic low value at 222, and then undergoing some transitions at 224, but then returning to a logic low value and continuing along the pathway indicated at 220. This type of waveform will occur when the piston stop wear has become so great that the driver 90 travels farther downward than it is supposed to. This becomes an out of specification situation, in which the driver's opening 95 will end up below its normal position, which on FIG. 8B would mean that the driver has moved too far in the direction "B". When that occurs, the DOWN sensor will see logic transitions, as at 224 on the top diagram of FIG. 13. However, instead of those transitions ending up in a logic high state for that DOWN sensor signal, the signal state drops back to logic low and stays there, as indicated at 220. The time mark $T_B$ along the X-axis of the top chart of FIG. 13 is the allowable determination time for the system controller to figure out whether or not there has been a failure of this type. In this situation, the system controller will cause the brake circuit to be applied, and this is referred to as a "Mode B" failure.

Some example timings can be discussed at this point; for a finishing tool such as the FUSION® tool sold by Senco, the time required between the start time (t1) and the nominal transition of the DOWN sensor (t3) is about 17 milliseconds. The maximum "normal" time ($T_N$) for the driver to transition "driven" position is about 30 milliseconds after the start time (t1).

The amount of time delay for making the decision about a Mode B failure can theoretically be anywhere between the time marks $T_N$ (at 30 msec) and $T_{MAX}$ (at 50 msec). However, the piston/driver combination tends to literally bounce against the piston stop, which is why there are multiple transitions at 234 on the bottom waveform chart of FIG. 14, and more to the point, there are potentially even more and longer transitions at 254 on the top waveform chart of FIG. 14—which depicts a situation where the piston stop has either considerably worn, or the operating temperature in the tool is quite hot, and thereby making the piston stop "soft" or otherwise more "bouncy." With that operational attribute in mind, the position of the time mark $T_B$ along the X-axis should be delayed toward the end of the driving stroke, to ensure that the driver has substantially settled down against the piston stop. Otherwise, the moment of sampling the input signal from the DOWN sensor might result in a false reading. Therefore, a relatively "safe" time mark for $T_B$ can be selected as about 45 milliseconds.

On the other hand, the amount of time delay for making the decision about a Mode A failure should be sooner, rather than later. As can be seen on the middle waveform chart of FIG. 13, there is no transition of the DOWN sensor's signal whatsoever, because the driver never arrived at its nominal "in specification" driven position. Of course, one must wait until at least the time mark t3 before sampling the DOWN sensor's signal, which is the expected nominal amount of time to see a DOWN sensor signal transition for an "in specification" tool. However, as the gas pressure slowly decreases over the life of the tool—typically after tens of thousands of driving cycles—the expected transition time for t3 will slowly increase. (See the discussion about a "dry fire" diagnostic test, in reference to the waveform charts of FIG. 15 and the flow chart of FIG. 18.) In addition, the test for a Mode A failure does not need to "wait" until the piston/driver combination has stopping bouncing. In the first place, if the driver fails to reach its nominal driven position, then it has likely jammed, so it won't be "bouncing around" in any event; secondly, the software executing in the system controller does not really need the driver to "settle down;" instead, the system controller samples the DOWN sensor multiple times (rather quickly), looking for any type of transition after the start time t1, and it is not looking to see what the "final" logic level is at a later time (such as the case when looking for a Mode B failure). (See the flow chart of FIG. 18.) Therefore, the Mode A failure decision can be taken much earlier, such as after 20 milliseconds after the start time—in sum, the time mark $T_A$ should be at about 20 msec after t1. One very important consideration is this: if the driver 90 has truly jammed somewhere "early" along the driver track 93, then it is quite desirable to stop moving the lifter 100 toward the driver 90 as soon as possible.

Note that there are de-bounce circuits available for many "rough" signals that are received by control systems for many, many real world applications. In the case of this fastener driving tool, a "regular" de-bounce circuit would probably not work very well, because the time delay involved in "waiting" for the bouncing piston/driver combination to settle out is several milliseconds in duration. Therefore, a standard time delay is more suitable, and this function is described herein as being performed by a "timer." It will be understood that such a "timer" can physically exist as computer code, rather than as a hardware timer—however, both methods of creating a time delay should work well in this tool control system.

On FIG. 13, the start signal is indicated at the timing mark t1. Moving along the X-axis (representing the passage of time), the next important time mark is designated t3, which identifies the initial transition of the DOWN sensor's signal. Continuing along the X-axis, the next important time is designated $T_N$, which stands for the maximum "normal" time required for the driver to transition from its starting or "ready" position to its finishing or "driven" position. As can be seen on the bottommost graph, the transition at 204 occurs before this time $T_N$ is reached, which makes this a "normal" waveform. Farther along the X-axis, the next important time is designated $T_{MAX}$, which stands for the maximum allowable time for deciding whether or not to apply the brake. For a finishing tool, such as the FUSION® tool being sold by Senco today, $T_{MAX}$ is approximately 50 milliseconds after the start time t1.

The $T_{MAX}$ attribute represents a critically important number, and must be observed for proper operation of these types of gas spring fastener driving tools. The main purpose of using the position sensors and analyzing their resulting waveforms is to prevent the lifter pins from impacting against the driver in a situation where the driver has ended up in an "out of specification" location in the driver track 93. On the bottommost chart of FIG. 13, t1 is the starting time in which the motor turns the lifter a small amount such that its engaging pin releases from the engaged protrusion or tooth 92 of the driver 90, thereby allowing the driver to be pushed by gas pressure (via the piston 80) downward through the driving track to engage a fastener, and then drive that fastener into a workpiece. This occurs quickly, and afterward, the time continues on the graph of FIG. 13, while the lifter motor is engaged and continues turning the lifter to move the driver back up from the driven position to its ready position. A certain minimum amount of time is needed to get the motor 40 started moving the lifter 100, and even then the lifter pins do not immediately engage the protrusions or teeth 92 of the driver 90. There is a small space in which the lifter pins have to travel (in an arcuate direction) before those pins will contact the driver teeth 92. If necessary, the brake circuit 140 can be engaged to prevent the physical contact between the lifter pins and the driver 90, and that decision must be made before reaching $T_{MAX}$. If done properly, the brake will quickly stop the rotary motion of the lifter subassembly 100, thereby preventing physical contact of the lifter pins and the driver, hopefully saving the driver from physical damage.

Figure 14:
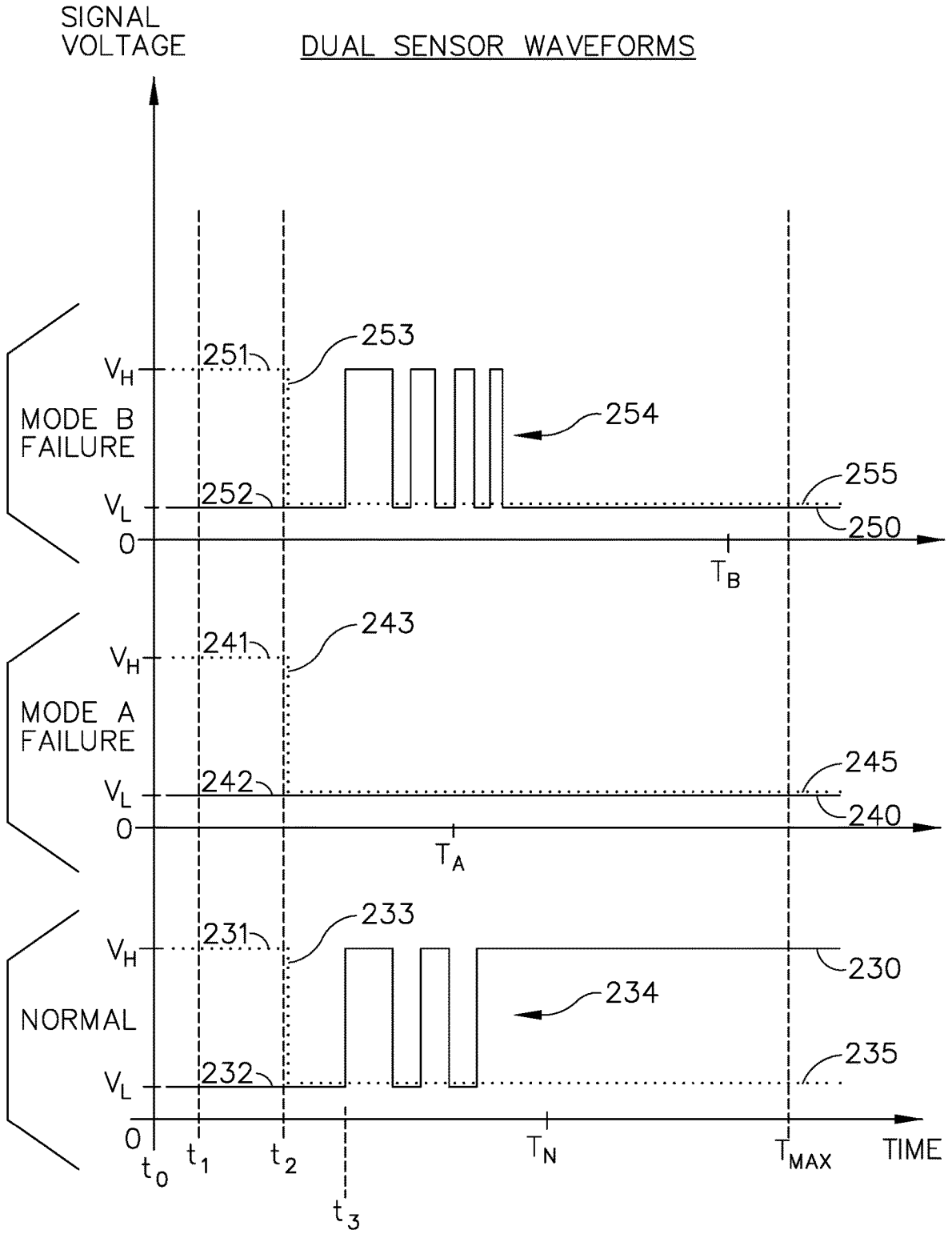
FIG. 14 is a chart showing three waveforms for a dual sensor embodiment of the fastener driving tool of FIG. 1.

Referring now to FIG. 14, another set of waveforms is presented showing the signals for a dual sensor fastener driving tool. The term "dual sensor" refers to the illustrated embodiment that has both an UP sensor and a DOWN sensor. The bottommost graph of FIG. 14 shows a "normal" situation, in which the DOWN sensor produces a "logic low" signal waveform at 232, and continues on for a while after actuation of a driving cycle at time mark t1, and finally a transition occurs at time mark t3, producing multiple transitions in the waveform at 234, as the DOWN sensor first receives a light beam, then has its light beam interrupted by the driver. Once that signal settles down, it ends up at a "logic high" state and continues on, as shown by the graph at 230.

The UP sensor starts out at a logic high state at the graph portion 231, and then transitions at a time mark t2, when the leading edge of the driver 97 passes by the UP sensor position. This transition is at the graph portion 233, and once that occurs the logic state of the signal remains low throughout the rest of the driving stroke, ending in a graph portion at 235.

On the graphs of FIG. 14, the symbols along the X-axis have the following meanings: the time mark t1 represents the starting time of the drive stroke, when the lifter motor 40 first begins rotating; time mark t2 represents the "normal" time that a transition is expected for the UP sensor to detect the leading edge 97 of the driver 90 moving past its position; $T_N$ represents the "normal" maximum amount of time to finish a driving stroke; and $T_{MAX}$ represents the maximum time allowable before the system controller must determine whether or not to apply the brake.

The bottommost graph of FIG. 14 shows a normal cycle, because the transition of the DOWN sensor (at t3) occurred between time marks t1 and $T_N$. Therefore, the driver moved its correct distance ("within specification"), such that the opening 95 allowed light to pass from the LED to the photodetector of the DOWN sensor.

The middle graph of FIG. 14 shows a different set of waveforms, because the DOWN sensor signal at 242 starts at a logic low value, but unfortunately remains at a logic low value at the drive stroke end at 240. The UP sensor worked correctly, starting with a logic high state at 241, then making a transition near time t2, in which the transition 243 on the graph becomes a lower logic state at graph portion 245. However, since the DOWN sensor signal never changed state by the time $T_A$, this indicates a Mode A failure.

The uppermost graph on FIG. 14 shows the DOWN sensor 252 starting at a logic low value, then making transitions at 254, and then finishing at a logic low value at 250. The UP sensor signal starts at 251 at a logic high value, transitions near the time t2 at a graph portion 253, and ends up at a logic low value at 255. This graph illustrates an abnormal event, because the DOWN sensor signal did not transition to a logic high state and stay there by the time $T_B$, and thus this indicates a Mode B failure. As in the graphs of FIG. 13, the two failure modes depicted on FIG. 14 indicate that the brake should be applied before reaching $T_{MAX}$.

With regard to actual timing of events, the time mark t2 represents the amount of time required before the bottom or "leading edge" 97 of the driver 90 moves to the detecting zone of the UP sensor 4. For a finishing tool such as the FUSION® tool sold by Senco, the time required between the start time (t1) and the nominal transition of the UP sensor (t2) is about 10 milliseconds.

It should be noted that the newer framing tool that is illustrated and described herein is a more powerful tool than the FUSION® finishing tool that has been on the market for some time. The charging pressure for a new FUSION® finishing tool is about 100 PSI, whereas the planned charging pressure for a new framing tool of the type described herein is about 130 PSI. (It will be understood that this planned charging pressure could be changed, as the design of this framing tool matures.) The overall effect of the difference in operating pressures, and different piston masses and sizes of fasteners used for these gas spring tools is that the timing values for t1, t2, t3, and $T_N$ are approximately the same for both tools.

But it will be understood that these timing values are merely examples of present design efforts, and they could be altered to a large extent for a very different type of tool, without departing from the principles of the technology disclosed herein. For example, a "regular" air tool—e.g., one that uses an air compressor with a compressed air hose attached to the tool during operation—could be equipped with similar UP and DOWN sensors, and still benefit from this new technology.

If the fastener driving tool is provided with two position sensors, as in the preferred embodiment illustrated herein, the tool can be tested for having sufficient gas pressure within the storage chamber. This test is referred to as a "dry fire test." The term "dry fire" refers to a situation where the fastener driving tool is cycled through a driving stroke, but there is no fastener magazine attached, so the driver 90 does not impact against a fastener, but merely transitions from its ready position to its driven position.

Figure 15:
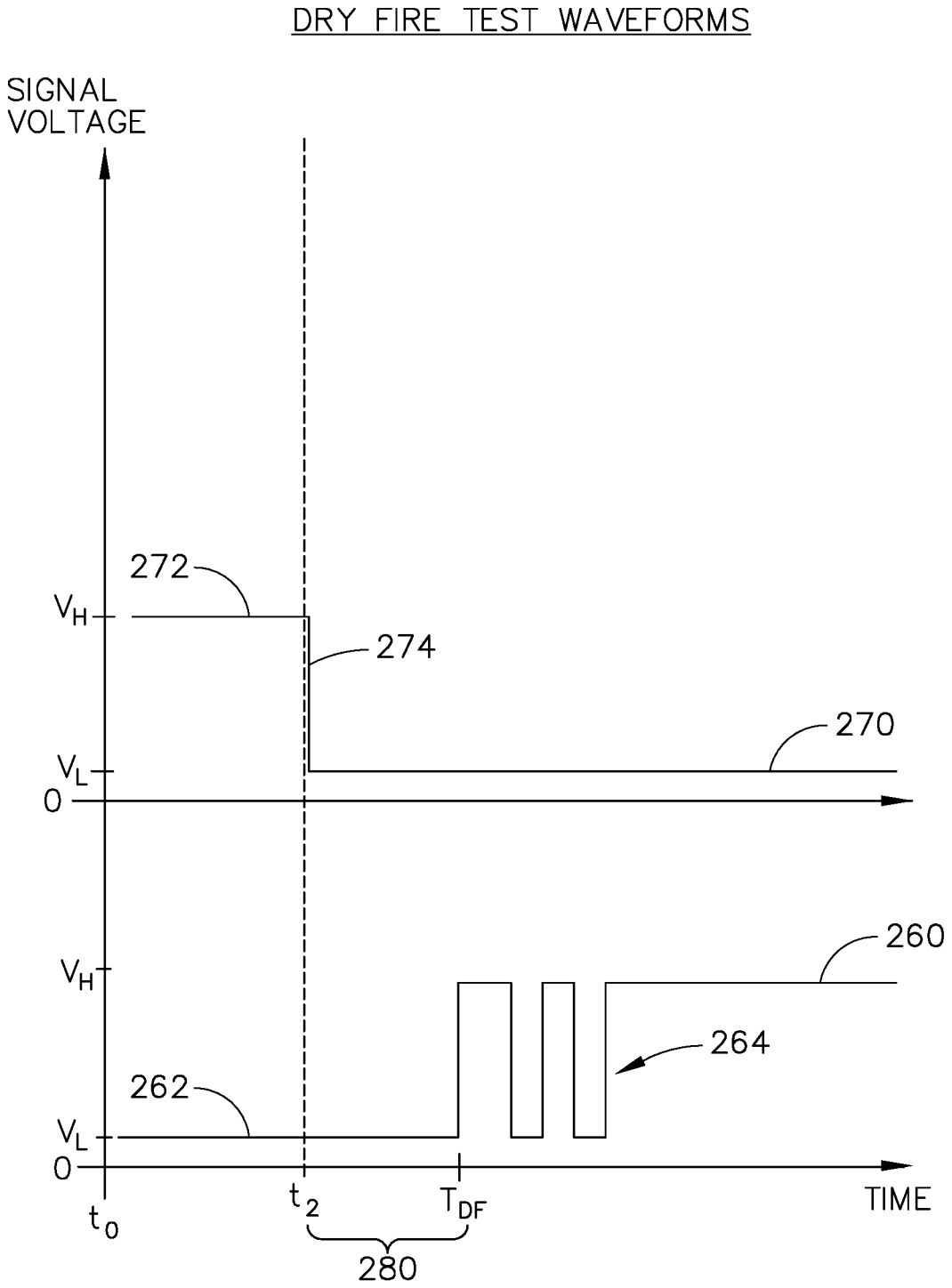
FIG. 15 is a graph showing the waveforms of the UP and DOWN sensors for a dry fire test of the fastener driving tool of FIG. 1.

On FIG. 15, the two graphs show the UP sensor signal and the DOWN sensor signal as individual graphs. The top graph shows the UP sensor signal starting at 272, which is a high logic state, then transitioning near the time t2 at a graph portion 274, and then ending at a lower logic state at 270. The DOWN sensor signal starts at 262, and then transitions at a time tDF, as shown by the set of transitions at 264. The DOWN sensor signal then ends up at a high logic state at 260. The time interval designated by the reference numeral 280 represents the time between the UP sensor transition event (at t2) and the first DOWN sensor signal transition (at tDF), which comprises a dry fire test cycle.

For a Senco finishing tool known as FUSION®, the time interval 280 (i.e., the delta time between t2 and tDF) should be approximately 7 milliseconds. If the time interval is in the range of 8 to 10 milliseconds, that indicates an abnormal result for the dry fire test, and additional pressurized gas needs to be added to the storage chamber of that tool. This type of diagnostic test was not possible in the field, before the addition of the position sensors, so this is a new, easily performed test that a user can perform at any time, without returning the tool to a service center.

In a working prototype framing tool, the current supplied to the LEDs for the UP and DOWN sensors was about 7 mA. The current supplied to the prototype's lifter motor 40 ("M1") by the motor driver circuit 160 was a pulse-width modulated voltage, using a power supply of about 18 volts DC. The initial duty cycle of the motor current was about 80%, using a 4 kHz drive voltage modulation frequency; after a "ramp-up" time interval, to overcome the lifter/driver inertia (while pushing against the high piston pressure near the top of its linear travel), the motor current duty cycle was increased to 100%. The prototype's lifter motor 40 was a four-pole permanent magnet DC motor. The prototype's braking circuit was designed to stop rotation within about two motor revolutions. It will be understood that the braking circuit could be faster, if that was needed, (by reversing the EMF at the motor terminals, for example), but such a fast braking speed does not seem to be necessary for this engineering application. It will also be understood that all of the physical characteristics disclosed above can be expected to change, perhaps dramatically, in a future design for a production fastener driving tool, without departing from the principles of the technology disclosed herein.

Figure 16:
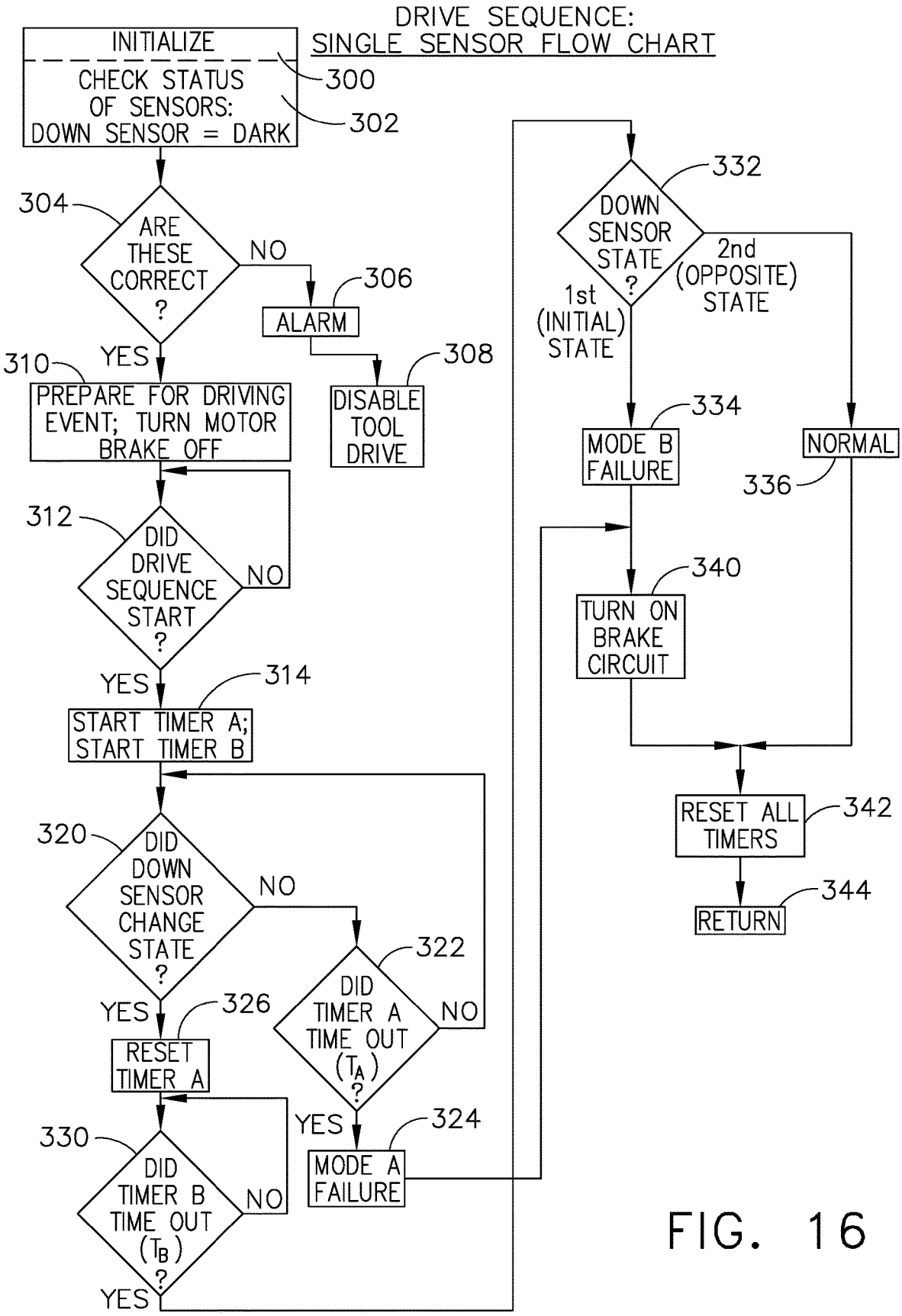
FIG. 16 is a flow chart showing some of the important logical steps performed by the controller of the fastener driving tool of FIG. 1, in which there is only a single sensor in that embodiment of the tool.

Referring now to FIG. 16, a flow chart is provided for a single sensor design. Beginning with an initialization step 300 for controlling a drive sequence, the first steps are to check the status of the sensors at a step 302. The DOWN sensor's state should be "dark," meaning that light should not be passing from the LED to the photodetector of the DOWN sensor 2. A decision step 304 determines if the system status is correct. Note that this includes more than just checking the DOWN sensor, because there are other sensors and conditions that must be tested before the tool should be allowed to cycle.

If the sensor status is not correct, or if there are some other types of determinative problems with the tool, then the tool enters an alarm state at step 306, and the tool driving system is disabled at a step 308. Assuming that the sensors and other conditions are correct at step 304, then the tool is prepared for a driving event at a step 310, and the brake circuit is turned off. A decision step 312 now determines whether or not a drive sequence has started. This portion of the logic essentially continues in a DO-loop until a drive sequence does start, and when that occurs two timers are started at a step 314. These timers are referred to as Timer A and Timer B.

A decision step 320 now determines whether or not the DOWN sensor has changed state. If not, then a decision step 322 determines whether or not Timer A has timed out (past the time interval $T_A$). If not, then the logic is directed back to the decision step 320 to see whether or not the DOWN sensor has yet changed state. On the other hand if Timer A does time out and decision step 322 takes note of that, then a Mode A failure has occurred and is so indicated at a step 324.

If the DOWN sensor changes state before the Timer A times out, then the logic is directed to a step 326, which resets Timer A, and the logic continues to a decision step 330 that now determines whether or not Timer B has timed out (past the time interval $T_B$). If the answer is NO, then the logic at this portion stays in a DO-loop until Timer B does time out. When that occurs, a decision step 332 determines whether or not the DOWN sensor is in its original state or its opposite state. If the DOWN sensor state has transitioned to its opposite state, then the logic is directed to a step 336 that declares this is a "normal" driving event. On the other hand, if the DOWN sensor state did not end up at its opposite state, and instead is back to its initial state, then the logic flow is directed to a step 334 which declares that a Mode B failure has occurred.

If either a Mode A failure or a Mode B failure has occurred, then the logic is directed to a step 340 that turns on the brake circuit. This is supposed to occur quickly enough to prevent the lifter pins from impacting against the driver 90. The logic flow now is directed to a step 342 that resets all timers. This occurs whether the tool underwent a normal driving event at step 336 or a failure mode had occurred. Once the timers are reset, this subroutine is finished at a return step 344.

Figure 17:
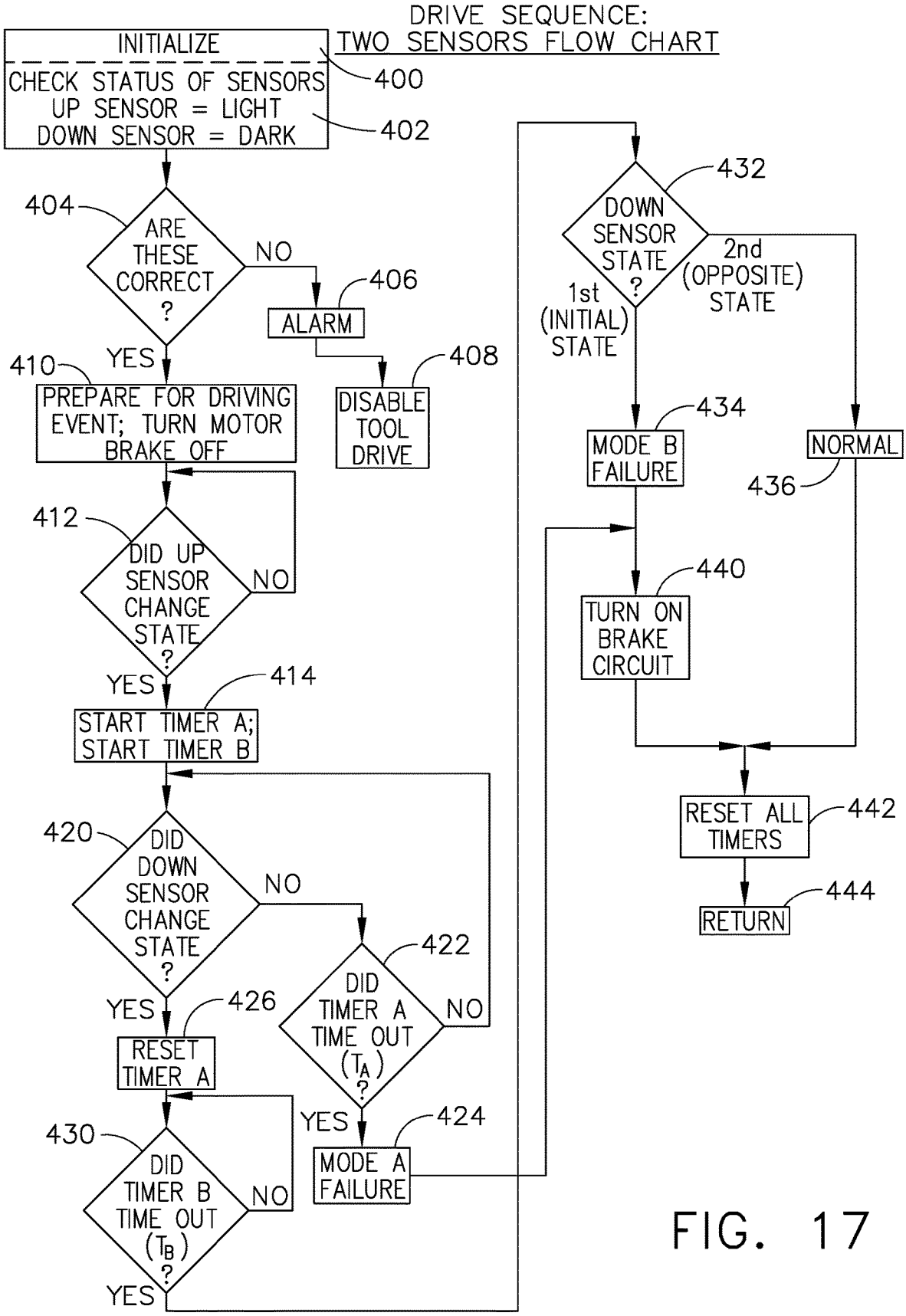
FIG. 17 is a flow chart showing some of the important logical steps performed by the controller of the fastener driving tool of FIG. 1, in which there are two sensors in that embodiment of the tool.

Referring now to FIG. 17, a flow chart is provided showing the drive sequence logic for a tool that has two sensors, i.e., both an UP sensor and a DOWN sensor. This logic flow chart begins with a step 400 to initialize the system for a prospective drive sequence. A step 402 determines the status of the sensors and other system requirements. The UP sensor 4 is supposed to have light on it from its LED, and the DOWN sensor 2 is supposed to be dark. A decision step 404 determines whether these are correct, and if not, an alarm state is entered at a step 406, and the tool drive sequence is disabled at a step 408.

If the initialization procedure shows that the sensors (and other conditions) are correct, then a step 410 prepares for a driving event and turns the brake circuit off. A decision step 412 now determines whether or not the UP sensor has changed state. If not, then the logic at this step becomes a DO-loop, until the UP sensor does change state. Once that occurs, a step 414 starts Timer A and starts Timer B.

A decision step 420 now determines whether or not the DOWN sensor has changed state. If not, then a decision step 422 determines whether or not Timer A has timed out (past the time interval $T_A$). If not, then the logic is directed back to the decision step 420 to determine whether or not the DOWN sensor has changed state. On the other hand, if Timer A has timed out, then step 422 directs the logic to a step 242 that declares a Mode A failure.

If the DOWN sensor has changed state at step 420 before the Timer A has timed out, then the logic is directed to a step 426 that resets Timer A, and then continues to a decision step 430 to determine whether or not Timer B has timed out (past a time interval $T_B$). If Timer B has not timed out, then the logic remains in a temporary DO-loop until Timer B does time out. Once that has occurred, a decision step 432 determines the state of the DOWN sensor. If the DOWN sensor has transitioned to an opposite state, then that is a normal sequence, as declared at a step 436. On the other hand, if the DOWN sensor has not transitioned to its opposite state at decision step 432, then a Mode B failure has occurred, which is declared at a step 434. If either a Mode A failure or a Mode B failure has occurred, then a step 440 turns on the brake circuit, and the indicator lamp 43 could illuminated, or could start flashing, for example. As in the flow chart of FIG. 16, the brake circuit is supposed to be applied sufficiently quickly to prevent the lifter pins from impacting against the driver 90.

In all situations, once the logic reaches a step 442, all timers are reset, and the logic has reached the end of this subroutine, at a return step 444.

Figure 18:
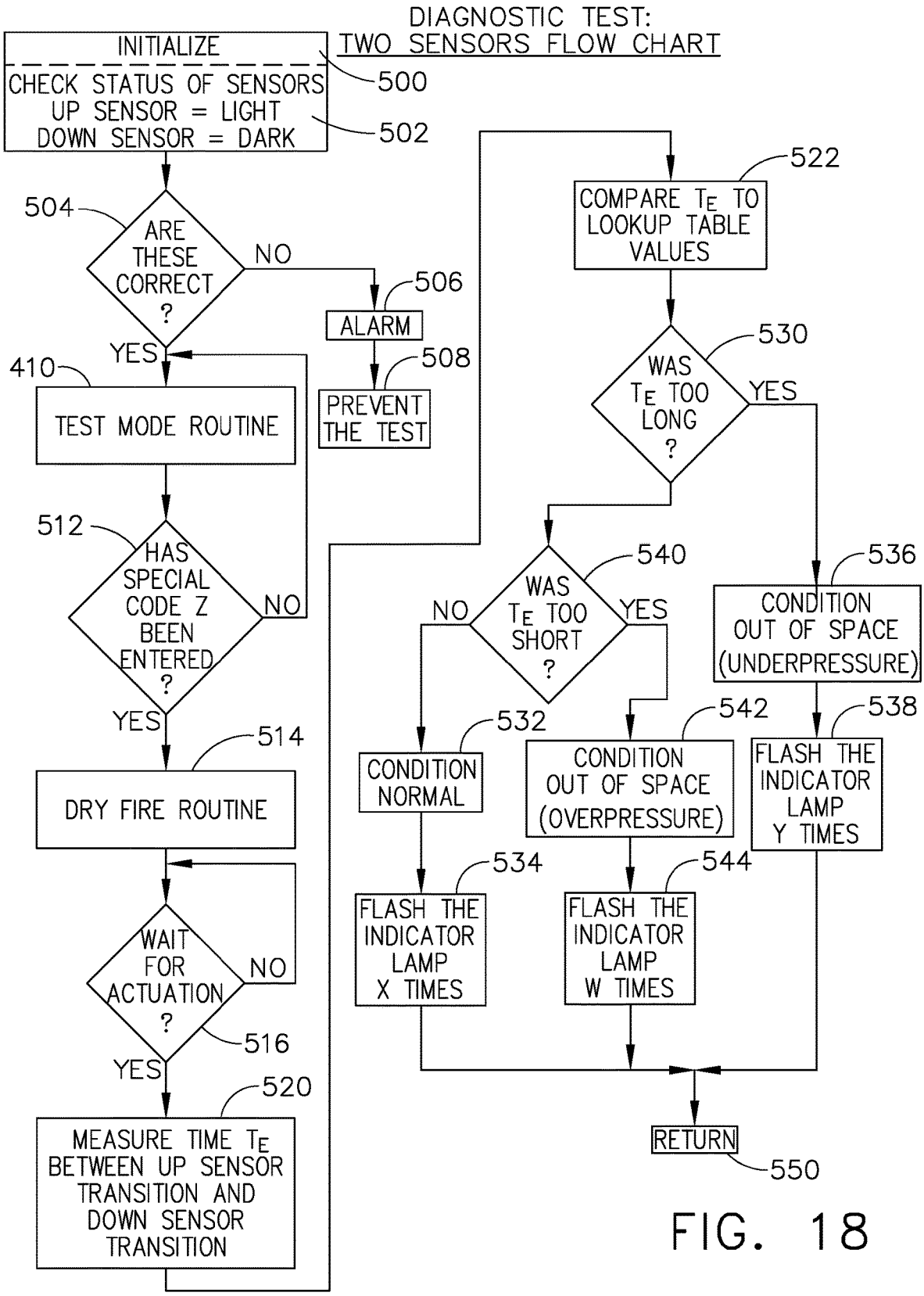
FIG. 18 is a flow chart showing some of the important logical steps performed by the controller of the fastener driving tool of FIG. 1, showing steps for a diagnostic test known as a "dry fire test."

Referring now to FIG. 18, a flow chart is provided showing the logic sequence for a diagnostic test known as the "dry fire" test. The flow chart begins at an initialization step 500, in which the sensors are inspected for the correct status at a step 502; other conditions of the tool are also checked. A decision step 504 determines whether or not the status of the sensors is correct, and if not, the logic is directed to an alarm state at a step 506, and the dry fire test is then prevented at a step 508.

If the system status is correct at step 504, then a step 510 now begins the diagnostic test mode routine. A decision step 512 determines whether or not the user has entered a special code "Z" into the tool's push buttons. (A user actuated button is provided on the tool that can have a certain predetermined code entered, which allows the tool to enter the test mode, and that code is referred to as special code Z.) If not, then the logic flow is directed back before the test mode routine begins, allowing the user to perform other diagnostic tests, if desired, or to function in other ways.

If the special code Z was entered at step 512, then the dry fire routine begins at a step 514. The tool now waits for actuation at a decision step 516, in a type of temporary DO-loop. Once actuation has occurred (this normally means that both the trigger has been actuated as well as the safety contact element), then a step 520 is reached. At step 520, a time $T_E$ is measured which represents a time interval between the UP sensor transition and the DOWN sensor transition. This time interval $T_E$ is compared to a predetermined value $T_F$, and to a predetermined value TG, or to corresponding values in a lookup table, at a step 522. A decision step 530 determines whether or not $T_E$ was too long in duration, and if so, the logic flow is directed to a step 536 that determines that the condition was out of specification. In this situation, the out of specification situation likely occurred due to an underpressure condition, and in that circumstance, a step 538 flashes an indicator lamp "Y" times. (The LED 43 can serve as the indicator lamp.) Other possible reasons for a "too long" result for time interval $T_E$ are, for example, a need for renewing the lubricant, or perhaps for replacing the piston seal, or sleeve, or some other component that might cause a "service required" condition.

On the other hand, if the time interval $T_E$ was not too long at step 530, then the logic flow is directed to a decision step 540 that determines whether or not $T_E$ was too short in duration, and if so, the logic flow is directed to a step 542 that determines that the condition was out of specification. In this situation, the out of specification situation likely occurred due to an overpressure condition, which might be the case if someone overfilled the main storage tank with pressurized gas during a refill servicing procedure. In that circumstance, a step 544 flashes the indicator lamp (e.g., LED 43) "W" times. (Note that, with the availability of this new "dry fire test" function, it would be wise to test the fastener driving tool immediately after performing such a gas refill servicing procedure as a standard procedure. It now becomes an easily-performed self test, with no additional equipment needed.)

However, if the time interval $T_E$ was not too short at step 540, then the logic is directed to a step 532, which declares that the condition was normal, and the logic flow is then directed to a step 534 that flashes the indicator lamp "X" times. The indicator lamp may be an LED on the fastener driving tool that the user can view, such as LED 43. The user will be expecting to see the LED flashing X times. If instead, however, the user sees the indicator lamp flash either Y times or W times, then the user becomes aware that the dry fire test failed and that the tool needs to be serviced. In all cases, the end of this subroutine has been reached, at a return step 550.

It should be noted that instead of a flashing lamp, an audio signal could be provided for the user, using some type of piezoelectric device, such as a device known as a Sonalert, or any other type of audio indicating device. Virtually any type of visible indicator or audible indicator could be used for announcing the dry fire test results. For example, if the fastener driving tool were to be provided with a small display monitor, then a verbal message could be displayed, if desired. For example, the verbal message could read, "UNDERPRESSURE" or "OVERPRESSURE." Also, the displayed messages could be in different colors for different types of results, if desired.

As can be seen from the above description, in a dual sensor tool, there are two independent electronic sensors that are placed in two different positions to monitor the position of the driver 90. The sensors preferably use a narrow beam infrared emitter (or LED) with a corresponding infrared receiver. The path of the infrared light is either blocked or is presented to the infrared receiver as a result of the driver position. As discussed above, the independent outputs from the UP and DOWN sensors create independent inputs to the system controller 50, which then uses logic to determine whether or not the tool is performing correctly or has entered a certain type of failure mode. A de-bouncing circuit can be used to compensate for spurious sensor outputs caused by normal tool motion.

If one of the failure modes occurs, the control electronics apply current to a dynamic brake which acts upon the motor. This dynamic brake effectively shorts the motor terminals to quickly stop the motor from rotating. By inhibiting rotation of the lifter motor 40, this also inhibits the rotation of the moving mass coupled to the motor, which is the lifter subassembly itself.

As briefly noted above, different types of sensors could be used, other than infrared optical sensors and emitters. Also, a different wavelength of light could used, such as ultraviolet light, or light in the visible spectrum. Yet other types of sensors could be used such as an eddy current sensor or a variable reluctance device could be used. These would all still be non-contact position sensors. Furthermore, other types of openings or protrusions off the driver could be used instead of a through-hole in the middle portion of the driver face, without departing from the principles of the technology disclosed herein. One advantage to this system is that it uses no type of mechanical system to stop rotation of the lifter, such as a mechanical clutch to decouple the motor and gearbox from the lifter. This is a benefit, since it prevents the unwanted motion before any drivetrain forces exceed design limits, without the complexity, weight, or noise of a mechanical clutch.

The elongated slot 95 in the face of the driver 40 that acts as the DOWN sensor positioning hole allows for variation in position of the driver due to normal tolerance stack up, air spring pressure variation (due to leakage over time, and temperature change), and piston stop degradation (i.e., wear).

As discussed above, the use of two position sensors not only provides for a somewhat more precise timing of the beginning of a drive cycle, but also allows for a diagnostic test known as the "dry fire test," without any additional hardware. This allows the user to test the sufficiency of the air pressure within the storage chamber without taking the tool to a service center.

Additional details about the structure and operating principles of FUSION-style tools are provided in earlier patent applications filed by Senco. These and other aspects of the present technology may have been present in earlier fastener driving tools sold by the Assignee, Senco Products, Inc., including information disclosed in previous U.S. patents and published applications. Examples of such publications are patent numbers U.S. Pat. Nos. 6,431,425; 5,927,585; 5,918,788; 5,732,870; 4,986,164; and 4,679,719; also U.S. Pat. Nos. 8,011,547, 8,267,296, 8,267,297, 8,011,441, 8,387,718, 8,286,722, 8,230,941, and 8,763,874, which are hereby incorporated by reference in their entirety. It will be understood that the principles described herein apply not only to nailer tools, but also to all types and sizes of fastener driving tools, including staplers.

It will be understood that the logical operations described in relation to the flow charts of FIGS. 16-18 can be implemented using sequential logic (such as by using microprocessor technology), or using a logic state machine, or perhaps by discrete logic; it even could be implemented using parallel processors. One preferred embodiment may use a microprocessor or microcontroller to execute software instructions that are stored in memory cells within an ASIC. In fact, the entire microprocessor (and microcontroller, for that matter), along with RAM and executable ROM, may be contained within a single ASIC, in one mode of the technology disclosed herein. Of course, other types of circuitry could be used to implement these logical operations depicted in the drawings without departing from the principles of the technology disclosed herein. In any event, some type of processing circuit will be provided, whether it is based on a microprocessor, a logic state machine, by using discrete logic elements to accomplish these tasks, or perhaps by a type of computation device not yet invented; moreover, some type of memory circuit will be provided, whether it is based on typical RAM chips, EEROM chips (including Flash memory), by using discrete logic elements to store data and other operating information (such as the dry fire lookup table data stored, for example, in memory circuit 152), or perhaps by a type of memory device not yet invented.

It will also be understood that the precise logical operations depicted in the flow charts of FIGS. 16-18, and discussed above, could be somewhat modified to perform similar, although perhaps not exact, functions without departing from the principles of the technology disclosed herein. The exact nature of some of the decision steps and other commands in these flow charts are directed toward specific future models of automatic fastener driving tools (those involving FUSION Senco nailers or screwdriving tools, for example) and certainly similar, but somewhat different, steps would be taken for use with other models or brands of fastener driving tools in many instances, with the overall inventive results being the same.

It will be further understood that any type of product described herein that has moving parts, or that performs functions (such as computers with processing circuits and memory circuits), should be considered a "machine," and not merely as some inanimate apparatus. Such "machine" devices should automatically include power tools, printers, electronic locks, and the like, as those example devices each have certain moving parts. Moreover, a computerized device that performs useful functions should also be considered a machine, and such terminology is often used to describe many such devices; for example, a solid-state telephone answering machine may have no moving parts, yet it is commonly called a "machine" because it performs well-known useful functions.

As used herein, the term "proximal" can have a meaning of closely positioning one physical object with a second physical object, such that the two objects are perhaps adjacent to one another, although it is not necessarily required that there be no third object positioned therebetween. In the technology disclosed herein, there may be instances in which a "male locating structure" is to be positioned "proximal" to a "female locating structure." In general, this could mean that the two male and female structures are to be physically abutting one another, or this could mean that they are "mated" to one another by way of a particular size and shape that essentially keeps one structure oriented in a predetermined direction and at an X-Y (e.g., horizontal and vertical) position with respect to one another, regardless as to whether the two male and female structures actually touch one another along a continuous surface. Or, two structures of any size and shape (whether male, female, or otherwise in shape) may be located somewhat near one another, regardless if they physically abut one another or not; such a relationship could still be termed "proximal" Or, two or more possible locations for a particular point can be specified in relation to a precise attribute of a physical object, such as being "near" or "at" the end of a stick; all of those possible near/at locations could be deemed "proximal" to the end of that stick. Moreover, the term "proximal" can also have a meaning that relates strictly to a single object, in which the single object may have two ends, and the "distal end" is the end that is positioned somewhat farther away from a subject point (or area) of reference, and the "proximal end" is the other end, which would be positioned somewhat closer to that same subject point (or area) of reference.

It will be understood that the various components that are described and/or illustrated herein can be fabricated in various ways, including in multiple parts or as a unitary part for each of these components, without departing from the principles of the technology disclosed herein. For example, a component that is included as a recited element of a claim hereinbelow may be fabricated as a unitary part; or that component may be fabricated as a combined structure of several individual parts that are assembled together. But that "multi-part component" will still fall within the scope of the claimed, recited element for infringement purposes of claim interpretation, even if it appears that the claimed, recited element is described and illustrated herein only as a unitary structure.

All documents cited in the Background and in the Detailed Description are, in relevant part, incorporated herein by reference; the citation of any document is not to be construed as an admission that it is prior art with respect to the technology disclosed herein.

The foregoing description of a preferred embodiment has been presented for purposes of illustration and description. It is not intended to be exhaustive or to limit the technology disclosed herein to the precise form disclosed, and the technology disclosed herein may be further modified within the spirit and scope of this disclosure. Any examples described or illustrated herein are intended as non-limiting examples, and many modifications or variations of the examples, or of the preferred embodiment(s), are possible in light of the above teachings, without departing from the spirit and scope of the technology disclosed herein. The embodiment(s) was chosen and described in order to illustrate the principles of the technology disclosed herein and its practical application to thereby enable one of ordinary skill in the art to utilize the technology disclosed herein in various embodiments and with various modifications as are suited to particular uses contemplated. This application is therefore intended to cover any variations, uses, or adaptations of the technology disclosed herein using its general principles. Further, this application is intended to cover such departures from the present disclosure as come within known or customary practice in the art to which this technology disclosed herein pertains and which fall within the limits of the appended claims.

What is claimed is:

1. A driver machine configured for use in a fastener driving tool, said driver machine comprising:

(a) a hollow cylinder having a movable piston therewithin;

(b) a guide body that is sized and shaped to receive a fastener that is to be driven;

(c) an elongated driver that is in mechanical communication with said piston during a driving stroke, said driver being sized and shaped to push said fastener from an exit portion of said guide body, said driver extending from a first end to a second end and having an elongated face therebetween, said first end being proximal to said piston, said second end being distal from said piston and making contact with said fastener during said driving stroke, said driver having an opening at a predetermined location in said elongated face that extends completely through said driver;

(d) a lifter that, under first predetermined conditions, moves said driver toward a ready position during a return stroke;

(e) an electrical energy source;

(f) a first position sensor which detects said driver opening if said driver is correctly located at a driven position after said driving stroke;

(g) a piston stop located between the hollow cylinder and the guide body; and (h) a system controller comprising: (i) a processing circuit, (ii) a memory circuit including instructions executable by said processing circuit, (iii) an input/output interface (I/O) circuit, said I/O circuit being in communication with said first position sensor so that a first signal produced by said first position sensor is received as a first input signal at said processing circuit;

wherein: said system controller is configured:

(i) under second predetermined conditions, to allow said driver to undergo said driving stroke, thereby moving said driver toward said driven position;

(ii) to determine a start time $T_X$ at a beginning of said driving stroke;

(iii) after said time $T_X$ occurs, to wait for a time interval $T_B$, then to determine if said first input signal is at a first logic state or a second logic state, such that: (A) if said first position sensor does not detect said driver opening, then said first input signal will be at said first logic state, and (B) if said first position sensor does detect said driver opening, then said first input signal will be at said second logic state;

(iv) if said first input signal is at said first logic state after said time interval $T_B$, then said driver machine is operating abnormally; and (v) if said first input signal is at said second logic state after said time interval $T_B$, then said driver machine is operating normally;

wherein: said driver opening is sized and shaped so as to prevent the first input signal to be at said second logic state if, after the driving stroke, the driver is located at a position that is too far toward the guide body, due to excessive wear of the piston stop.

2. The driver machine of claim 1, wherein said system controller is further configured:

(i) after said time $T_X$ occurs, to wait for a time interval $T_A$, then to determine if said first input signal changed state at least once after said time $T_X$, such that;

(ii) if said first input signal did not change state between said time $T_X$ and said time interval $T_A$, then said driver machine is operating abnormally; and (iii) if said first input signal did change state between said time $T_X$ and said time interval $T_A$, then said driver machine may be operating normally, depending upon other conditions.

3. The driver machine of claim 2, wherein said time interval $T_A$ is shorter than said time interval $T_B$.

4. The driver machine of claim 1, further comprising:

(a) a prime mover that is powered by said electrical energy source, said prime mover causing said lifter to move, under said first predetermined conditions; and (b) a braking circuit that, when actuated, quickly stops motion of said prime mover;

wherein said system controller is further configured:

(i) if said driver machine has been determined to be operating abnormally, then before a time interval $T_{MAX}$ has occurred, to actuate said braking circuit to prevent said lifter from substantially making physical contact with said driver, thereby preventing said return stroke from occurring; and (ii) if said driver machine has been determined to be operating normally, then to allow said lifter to make physical contact with said driver, thereby causing said return stroke to occur such that said driver is moved toward said ready position.

5. The driver machine of claim 1, wherein: if said driver machine has been determined to be operating abnormally, then said system controller prevents further operation of said driver machine until it has been serviced.

6. The driver machine of claim 1, wherein: said driver exhibits a plurality of spaced-apart protrusions along at least one longitudinal edge; and said lifter exhibits a plurality of extensions that protrude from said lifter's surface that engage at least one of said plurality of spaced-apart protrusions of said driver to cause said driver to move toward said ready position during said return stroke.

7. The driver machine of claim 1, further comprising: a storage chamber that is in fluidic communication at all times with said cylinder, such that said storage chamber and said cylinder are initially charged with a pressurized gas and remain above atmospheric pressure during all portions of an operating cycle, in which said pressurized gas is re-used for more than one driving cycle; and wherein: said cylinder and piston act as a gas spring, under second predetermined conditions, to move said driver toward its driven position, using said pressurized gas of both said storage chamber and said cylinder acting on said piston.

8. The driver machine of claim 1, further comprising: a second position sensor which is installed proximal to said second end of said driver if said driver is at said ready position, wherein said second position sensor detects motion of the driver if said driver begins moving through said driving stroke, toward said driven position.

9. A driver machine configured for use in a fastener driving tool, said driver machine comprising:

(a) a hollow cylinder having a movable piston therewithin;

(b) a guide body that is sized and shaped to receive a fastener that is to be driven;

(c) an elongated driver that is in mechanical communication with said piston during a driving stroke, said driver being sized and shaped to push said fastener from an exit portion of said guide body, said driver extending from a first end to a second end and having an elongated face therebetween, said first end being proximal to said piston, said second end being distal from said piston and making contact with said fastener during said driving stroke, said driver having an opening at a predetermined location in said elongated face that extends completely through said driver;

(d) a lifter that, under first predetermined conditions, moves said driver toward a ready position during a return stroke;

(e) an electrical energy source;

(f) a first position sensor which detects said driver opening if said driver is correctly located at a driven position after said driving stroke;

(g) a piston stop located between the hollow cylinder and the guide body; and (h) a system controller comprising: (i) a processing circuit, (ii) a memory circuit including instructions executable by said processing circuit, (iii) an input/output interface (I/O) circuit, said I/O circuit being in communication with said first position sensor so that a first signal produced by said first position sensor is received as a first input signal at said processing circuit;

wherein: said system controller is configured:

(i) under second predetermined conditions, to allow said driver to undergo said driving stroke, thereby moving said driver toward said driven position;

(ii) to determine a start time $T_X$ at a beginning of said driving stroke;

(iii) after said time $T_X$ occurs, to wait for a time interval $T_A$, then to determine if said first input signal changed state at least once after said time $T_X$, such that;

(iv) if said first input signal did not change state between said time $T_X$ and said time interval $T_A$, then said driver machine is operating abnormally; and (v) if said first input signal did change state between said time $T_X$ and said time interval $T_A$, then said driver machine may be operating normally, depending upon other conditions;

wherein: said driver opening is sized and shaped so that, after the driving stroke, if the driver is located at a position that is too far toward the guide body due to excessive wear of the piston stop, said first position sensor will not detect the driver opening.

10. The driver machine of claim 9, further comprising:

(a) a prime mover that is powered by said electrical energy source, said prime mover causing said lifter to move, under said first predetermined conditions; and (b) a braking circuit that, when actuated, quickly stops motion of said prime mover;

wherein said system controller is further configured:

(i) if said driver machine has been determined to be operating abnormally, then before a time interval $T_{MAX}$ has occurred, to actuate said braking circuit to prevent said lifter from substantially making physical contact with said driver, thereby preventing said return stroke from occurring; and (ii) if said driver machine has been determined to be operating normally, then to allow said lifter to make physical contact with said driver, thereby causing said return stroke to occur such that said driver is moved toward said ready position.

11. The driver machine of claim 9, wherein: if said driver machine has been determined to be operating abnormally, then said system controller prevents further operation of said driver machine until it has been serviced.

12. A driver machine configured for use in a fastener driving tool, said driver machine comprising:

(a) a hollow cylinder having a movable piston therewithin;

(b) a guide body that is sized and shaped to receive a fastener that is to be driven;

(c) an elongated driver that is in mechanical communication with said piston during a driving stroke, said driver being sized and shaped to push said fastener from an exit portion of said guide body, said driver extending from a first end to a second end and having an elongated face therebetween, said first end being proximal to said piston, said second end being distal from said piston and making contact with said fastener during said driving stroke, said driver having an opening at a predetermined location in said elongated face that extends completely through said driver;

(d) a lifter that, under first predetermined conditions, moves said driver toward a ready position during a return stroke;

(e) an electrical energy source;

(f) a first position sensor which detects said driver opening if said driver is correctly located at a driven position after said driving stroke;

(g) a second position sensor which detects motion of the driver if said driver begins moving through said driving stroke, toward said driven position;

(h) a piston stop located between the hollow cylinder and the guide body; and (i) a system controller comprising: (i) a processing circuit, (ii) a memory circuit including instructions executable by said processing circuit, (iii) an input/output interface (I/O) circuit, said I/O circuit being in communication with said first position sensor so that a first signal produced by said first position sensor is received as a first input signal at said processing circuit, and said I/O circuit being in communication with said second position sensor so that a second signal produced by said second position sensor is received as a second input signal at said processing circuit;

wherein: said system controller is configured:

(i) under second predetermined conditions, to allow said driver to undergo said driving stroke, thereby moving said driver toward said driven position;

(ii) to determine a time $T_X$ when said second input signal first changes state, after said driver begins said driving stroke;

(iii) after said time $T_X$ occurs, to wait for a time interval $T_A$, then to determine if said first input signal changed state at least once after said time $T_X$, such that;

(iv) if said first input signal did not change state between said time $T_X$ and said time interval $T_A$, then said driver machine is operating abnormally; and (v) if said first input signal did change state between said time $T_X$ and said time interval $T_A$, then said driver machine may be operating normally, depending upon other conditions;

wherein: said driver opening is sized and shaped so that, after the driving stroke, if the driver is located at a position that is too far toward the guide body due to excessive wear of the piston stop, said first position sensor will not detect the driver opening.

13. A driver machine configured for use in a fastener driving tool, said driver machine comprising:

(a) a hollow cylinder having a movable piston therewithin;

(b) a guide body that is sized and shaped to receive a fastener that is to be driven;

(c) an elongated driver that is in mechanical communication with said piston during a driving stroke, said driver being sized and shaped to push said fastener from an exit portion of said guide body, said driver extending from a first end to a second end and having an elongated face therebetween, said first end being proximal to said piston, said second end being distal from said piston and making contact with said fastener during said driving stroke, said driver having an opening at a predetermined location in said elongated face that extends completely through said driver;

(d) a lifter that, under first predetermined conditions, moves said driver toward a ready position during a return stroke;

(e) an electrical energy source;

(f) a first position sensor which detects said driver opening if said driver is correctly located at a driven position after said driving stroke;

(g) a second position sensor which detects motion of the driver if said driver begins moving through said driving stroke, toward said driven position;

(h) a piston stop located between the hollow cylinder and the guide body; and (i) a system controller comprising: (i) a processing circuit, (ii) a memory circuit including instructions executable by said processing circuit, (iii) an input/output interface (I/O) circuit, said I/O circuit being in communication with said first position sensor so that a first signal produced by said first position sensor is received as a first input signal at said processing circuit, and said I/O circuit being in communication with said second position sensor so that a second signal produced by said second position sensor is received as a second input signal at said processing circuit;

wherein: said system controller is configured:

(i) under second predetermined conditions, to allow said driver to undergo said driving stroke, thereby moving said driver toward said driven position;

(ii) to determine a time $T_X$ when said second input signal first changes state, after said driver begins said driving stroke;

(iii) after said time $T_X$ occurs, to wait for a time interval $T_B$, then to determine if said first input signal is at a first logic state or a second logic state, such that: (A) if said first position sensor does not detect said driver opening, then said first input signal will be at said first logic state, and (B) if said first position sensor does detect said driver opening, then said first input signal will be at said second logic state;

(iv) if said first input signal is at said first logic state after said time interval $T_B$, then said driver machine is operating abnormally; and (v) if said first input signal is at said second logic state after said time interval $T_B$, then said driver machine is operating normally;

wherein: said driver opening is sized and shaped so as to prevent the first input signal to be at said second logic state if, after the driving stroke, the driver is located at a position that is too far toward the guide body, due to excessive wear of the piston stop.

14. The driver machine of claim 13, wherein said system controller is further configured:

(i) after said time $T_X$ occurs, to wait for a time interval $T_A$, then to determine if said first input signal changed state at least once after said time $T_X$, such that;

(ii) if said first input signal did not change state between said time $T_X$ and said time interval $T_A$, then said driver machine is operating abnormally; and (iii) if said first input signal did change state between said time $T_X$ and said time interval $T_A$, then said driver machine may be operating normally, depending upon other conditions.

15. The driver machine of claim 14, wherein said time interval $T_A$ is shorter than said time interval $T_B$.

* * * * *